US012768553B2

(12) United States Patent
Kato et al.

(10) Patent No.: US 12,768,553 B2
(45) Date of Patent: Oct. 20, 2026

(54) EQUIPMENT MANAGEMENT SYSTEM AND REFRIGERANT AMOUNT ESTIMATION METHOD

(71) Applicant: Mitsubishi Electric Corporation, Tokyo (JP)

(72) Inventors: Shun Kato, Tokyo (JP); Hirotoshi Yano, Tokyo (JP)

(73) Assignee: Mitsubishi Electronic Corporation, Tokyo (JP)

( * ) Notice: Subject to any disclaimer, the term of this patent is extended or adjusted under 35 U.S.C. 154(b) by 380 days.

(21) Appl. No.: 18/573,537

(22) PCT Filed: Jan. 13, 2022

(86) PCT No.: PCT/JP2022/000849
§ 371 (c)(1),
(2) Date: Dec. 22, 2023

(87) PCT Pub. No.: WO2023/135696
PCT Pub. Date: Jul. 20, 2023

(65) Prior Publication Data
US 2024/0288190 A1 Aug. 29, 2024

(51) Int. Cl.
*F24F 11/36* (2018.01)
*F24F 11/52* (2018.01)
(Continued)

(52) U.S. Cl.
CPC ..... *F24F 11/36* (2018.01); *F24F 11/52* (2018.01); *F24F 11/63* (2018.01); *F24F 2140/20* (2018.01)

(58) Field of Classification Search
CPC .. F24F 11/52; F24F 11/36; F24F 11/63; F24F 11/48; F24F 11/38; F24F 2140/20; F25B 49/02
(Continued)

(56) References Cited

U.S. PATENT DOCUMENTS

2009/0044551 A1 2/2009 Kasahara
2011/0144948 A1 6/2011 Nishino et al.
(Continued)

FOREIGN PATENT DOCUMENTS

JP 46-035331 Y 12/1971
JP H10176877 A 6/1998
(Continued)

OTHER PUBLICATIONS

Office Action dated Aug. 6, 2024 issued in corresponding JP patent application No. 2023-573707 (and English Machine Translation).
(Continued)

*Primary Examiner* — Jigneshkumar C Patel
(74) *Attorney, Agent, or Firm* — Posz Law Group, PLC

(57) ABSTRACT

An equipment management system includes: an equipment having a refrigerant; an acquisition unit configured to acquire measurement information indicating a result of measuring a temperature of the refrigerant in the equipment, electrical characteristics of the equipment, and environmental information around the equipment; and an estimation unit configured to estimate an amount of the refrigerant in the equipment based on the measurement information acquired by the acquisition unit, equipment information on the equipment and equipment installation information on an installation environment of the equipment, the equipment information and the equipment installation information being preset.

20 Claims, 19 Drawing Sheets

(51) Int. Cl.
*F24F 11/63* (2018.01)
*F24F 140/20* (2018.01)

(58) Field of Classification Search
USPC ..... 700/276
See application file for complete search history.

(56) References Cited

U.S. PATENT DOCUMENTS

| | | | | |
|---|---|---|---|---|
| 2012/0318011 | A1* | 12/2012 | Ochiai | F25B 49/005 62/127 |
| 2013/0167567 | A1* | 7/2013 | Fukui | F25B 25/005 62/115 |
| 2015/0159931 | A1 | 6/2015 | Okada et al. | |
| 2015/0176880 | A1* | 6/2015 | Ochiai | F25B 13/00 62/190 |
| 2019/0178505 | A1* | 6/2019 | Peck | F24F 11/85 |

FOREIGN PATENT DOCUMENTS

| | | | |
|---|---|---|---|
| JP | H10205859 | A | 8/1998 |
| JP | 2005098642 | A | 4/2005 |
| JP | 2005114184 | A | 4/2005 |
| JP | 2007-198710 | A | 8/2007 |
| JP | 2010-048433 | A | 3/2010 |
| JP | 2012211723 | A | 11/2012 |
| JP | 2013-250038 | A | 12/2013 |
| JP | 2014234977 | A | 12/2014 |
| JP | 2017-026262 | A | 2/2017 |
| JP | 2017-150677 | A | 8/2017 |
| JP | 2019045035 | A | 3/2019 |
| JP | 2020153618 | A | 9/2020 |
| JP | 2021156532 | A | 10/2021 |
| WO | 2010/021101 | A1 | 2/2010 |
| WO | 2011/111114 | A1 | 9/2011 |
| WO | 2014/017161 | A1 | 1/2014 |

OTHER PUBLICATIONS

Japanese Office Action mailed Jun. 3, 2025 in corresponding Japanese Patent Application No. 2024-174366 (and English machine translation).

International Search Report of the International Searching Authority mailed Feb. 15, 2022 for the corresponding International Application No. PCT/JP2022/000849 (and English translation).

* cited by examiner

*FIG. 3*

<table>
<tr><th>MEASUREMENT POINT</th><th colspan="2">DURING COOLING</th><th colspan="2">DURING HEATING</th></tr>
<tr><td>T1</td><td colspan="4">DISCHARGE TEMPERATURE</td></tr>
<tr><td>T2</td><td rowspan="3">CONDENSER</td><td>INLET TEMPERATURE</td><td rowspan="3">EVAPORATOR</td><td>OUTLET TEMPERATURE</td></tr>
<tr><td>T2-3</td><td>INTERMEDIATE TEMPERATURE</td><td>INTERMEDIATE TEMPERATURE</td></tr>
<tr><td>T3</td><td>OUTLET TEMPERATURE</td><td>INLET TEMPERATURE</td></tr>
<tr><td>T4</td><td rowspan="2">EXPANSION VALVE</td><td>INLET TEMPERATURE</td><td rowspan="2">EXPANSION VALVE</td><td>OUTLET TEMPERATURE</td></tr>
<tr><td>T5</td><td>OUTLET TEMPERATURE</td><td>INLET TEMPERATURE</td></tr>
<tr><td>T6</td><td rowspan="3">EVAPORATOR</td><td>INLET TEMPERATURE</td><td rowspan="3">CONDENSER</td><td>OUTLET TEMPERATURE</td></tr>
<tr><td>T6-7</td><td>INTERMEDIATE TEMPERATURE</td><td>INTERMEDIATE TEMPERATURE</td></tr>
<tr><td>T7</td><td>OUTLET TEMPERATURE</td><td>INLET TEMPERATURE</td></tr>
<tr><td>T8</td><td colspan="4">SUCTION TEMPERATURE</td></tr>
</table>

*FIG. 8*

| EQUIPMENT ACQUISITION DATA | | | | | | | | | | |
|---|---|---|---|---|---|---|---|---|---|---|
| No. | REFRIGERANT TEMPERATURE | | No. | ELECTRICAL INPUT | | | No. | ENVIRONMENTAL INFORMATION | |
| 1 | DISCHARGE TEMPERATURE | | 1 | INDOOR UNIT | FAN | BUS VOLTAGE | 1 | INDOOR | TEMPERATURE |
| 2 | CONDENSER | INLET TEMPERATURE | 2 | | | BUS CURRENT | 2 | | HUMIDITY |
| 3 | | INTERMEDIATE TEMPERATURE | 3 | | | CURRENT ROTATION SPEED | 3 | OUTDOOR | TEMPERATURE |
| 4 | | OUTLET TEMPERATURE | 4 | | | COMMAND ROTATION SPEED | 4 | | HUMIDITY |
| 5 | EXPANSION VALVE | INLET TEMPERATURE | 5 | | WIRELESS DEVICE | POWER CONSUMPTION | | | |
| 6 | | OUTLET TEMPERATURE | 6 | OUTDOOR UNIT | PRIMARY VOLTAGE | | | | |
| 7 | EVAPORATOR | INLET TEMPERATURE | 7 | | PRIMARY CURRENT | | | | |
| 8 | | INTERMEDIATE TEMPERATURE | 8 | | COMPRESSOR | BUS VOLTAGE | | | |
| 9 | | OUTLET TEMPERATURE | 9 | | | BUS CURRENT | | | |
| 10 | SUCTION TEMPERATURE | | 10 | | | CURRENT FREQUENCY | | | |
| | | | 11 | | | COMMAND FREQUENCY | | | |
| | | | 12 | | FAN | BUS VOLTAGE | | | |
| | | | 13 | | | BUS CURRENT | | | |
| | | | 14 | | | CURRENT FREQUENCY | | | |
| | | | 15 | | | COMMAND FREQUENCY | | | |
| | | | 16 | | EXPANSION VALVE | CURRENT OPENING DEGREE | | | |
| | | | 17 | | | COMMAND OPENING DEGREE | | | |
| | | | 18 | | HEATER | ENVIRONMENTAL INFORMATION | | | |

*FIG. 9*

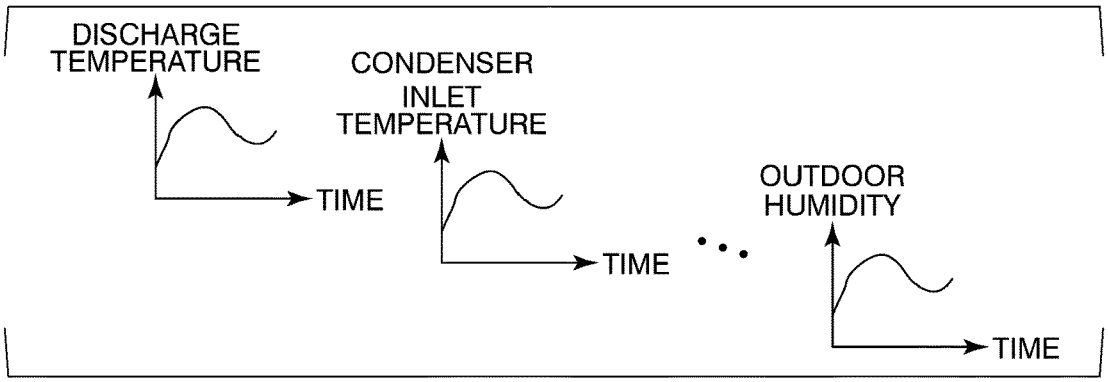

*FIG. 10*

| EQUIPMENT INFORMATION | | | | | | | |
|---|---|---|---|---|---|---|---|
| No. | COMMON ITEM | | UNIT | No. | INSPECTION DATA | | UNIT |
| 1 | DATE AND TIME | 2021/8/27 10:00 | - | 1 | TEST CONDITION | COOLING STANDARD | |
| 2 | TESTING ROOM | R/C-E | - | 2 | OUTDOOR DB | 27.00 | ℃ |
| 3 | LOT NUMBER | AAA | - | 3 | OUTDOOR WB | 19.00 | ℃ |
| 4 | MODEL | ZW | - | 4 | INDOOR DB | 35.00 | ℃ |
| 5 | CAPACITY | 71 | - | 5 | INDOOR WB | 24.00 | ℃ |
| 6 | YEAR | 20 | - | 6 | INDOOR CAPACITY | 7.821 | kW |
| 7 | SPECIFICATION OF POWER SUPPLY | S | - | 7 | POWER CONSUMPTION | 2.291 | kW |
| 8 | REFRIGERANT TYPE | R32 | - | 8 | COMMAND FREQUENCY OF COMPRESSOR | 94 | Hz |
| 9 | CHARGED AMOUNT | 1.25 | kg | 9 | COMMAND ROTATION SPEED OF INDOOR FAN | 1240 | rpm |
| 10 | REFRIGERATING MACHINE OIL | ABC12 | - | 10 | COMMAND ROTATION SPEED OF OUTDOOR FAN | 1100 | rpm |
| 11 | OIL AMOUNT | 333 | g | 11 | COMMAND OPENING DEGREE OF EXPANSION VALVE | 325 | pluse |
| 12 | MODEL OF COMPRESSOR | SVB | - | 12 | THERMAL CHARACTERISTICS OF OUTDOOR HEAT EXCHANGER | 0.35 | kW/K |
| 13 | STROKE VOLUME | 14.0 | cc | 13 | THERMAL CHARACTERISTICS OF INDOOR HEAT EXCHANGER | 0.29 | kW/K |
| 14 | SPECIFICATION OF COMPRESSOR MOTOR | FDFH | - | 14 | DISCHARGE TEMPERATURE | 94.2 | ℃ |
| 15 | INTERNAL VOLUME OF COMPRESSOR | 250 | cc | 15 | INLET TEMPERATURE OF CONDENSER | 89.3 | ℃ |
| 16 | INTERNAL VOLUME OF OUTDOOR HEAT EXCHANGER | 700 | cc | 16 | OUTLET TEMPERATURE OF CONDENSER | 36.8 | ℃ |
| 17 | INTERNAL VOLUME OF INDOOR HEAT EXCHANGER | 500 | cc | 17 | INLET TEMPERATURE OF EVAPORATOR | 16.1 | ℃ |
| 18 | INTERNAL VOLUME OF RECEIVER | 150 | cc | 18 | OUTLET TEMPERATURE OF EVAPORATOR | 7.6 | ℃ |
| | | | | 19 | SUCTION TEMPERATURE | 8.8 | ℃ |

*FIG. 11*

| EQUIPMENT INSTALLATION INFORMATION | | | |
|---|---|---|---|
| No. | ITEM | | UNIT |
| 1 | INSTALLATION LOCATION (LATITUDE) | 35.68 | - |
| 2 | INSTALLATION LOCATION (LONGITUDE) | 139.76 | - |
| 3 | BUILDING SPECIFICATION | WOODEN STRUCTURE | - |
| 4 | INSTALLATION DIRECTION | NORTH | - |
| 5 | INSTALLATION METHOD OF OUTDOOR UNIT | ON ROOF | - |
| 6 | HEIGHT OF INDOOR UNIT | 1.6 | m |
| 7 | SIZE OF INDOOR SPACE | 35.6 | $m^2$ |
| 8 | LENGTH OF INTERNAL-EXTERNAL CONNECTION PIPE | 8 | m |
| 9 | DIAMETER OF INTERNAL-EXTERNAL CONNECTION (LIQUID) PIPE | 6.35 | mm |
| 10 | DIAMETER OF INTERNAL-EXTERNAL CONNECTION (GAS) PIPE | 12.7 | mm |
| 11 | INDOOR-OUTDOOR HEIGHT DIFFERENCE | 10 | m |

EQUIPMENT MANAGEMENT SYSTEM AND REFRIGERANT AMOUNT ESTIMATION METHOD

CROSS-REFERENCE TO RELATED APPLICATION

This application is a U.S. National Stage Application of International Application No. PCT/JP2022/000849 filed on Jan. 13, 2022, the contents of which are incorporated herein by reference.

TECHNICAL FIELD

The present disclosure relates to an equipment management system and a refrigerant amount estimation method.

BACKGROUND

An air conditioner is disclosed which estimates an amount of refrigerant in the equipment by adjusting a temperature so that the temperature in a target space satisfies a predetermined determination temperature condition and measuring a refrigerant temperature under a stable condition (see, for example, Patent Document 1).

PATENT DOCUMENT

[Patent Document 1] Japanese Patent Application Publication No. 2007-198710

In the conventional technology disclosed in Patent Document 1, it is possible to estimate the amount of refrigerant when air conditioning loads of an outdoor unit and an indoor unit are constant, a compressor frequency is constant, and a refrigeration cycle is stable. However, because an outside temperature is not constant throughout the day, the air conditioning load on the indoor unit changes depending on the number of people in a room, an activity status of people in the room, and the like, so that an environment where the air conditioning load is constant does not exist in reality. Therefore, in the conventional technology, it has been difficult to estimate the amount of refrigerant in an actual usage environment, and special operation has been required to estimate the amount of refrigerant.

SUMMARY

The present disclosure has been made in view of the above circumstances, and has an object to provide an equipment management system and a refrigerant amount estimation method which accurately estimate an amount of refrigerant in an equipment in an actual usage environment without requiring special operation.

An equipment management system according to the present disclosure includes: an equipment having a refrigerant; an acquisition unit configured to acquire measurement information indicating a result of measuring a temperature of the refrigerant in the equipment, electrical characteristics of the equipment, and environmental information around the equipment; and an estimation unit configured to estimate an amount of the refrigerant in the equipment based on the measurement information acquired by the acquisition unit, equipment information on the equipment and equipment installation information on an installation environment of the equipment, the equipment information and the equipment installation information being preset.

Further, a refrigerant amount estimation method, according to the present disclosure, of estimating an amount of a refrigerant in an equipment having the refrigerant, includes: a step of an acquisition unit acquiring measurement information indicating a result of measuring a temperature of the refrigerant in the equipment, electrical characteristics of the equipment, and environmental information around the equipment; and a step of an estimation unit estimating an amount of the refrigerant in the equipment based on the measurement information acquired by the acquisition unit, equipment information on the equipment and equipment installation information on an installation environment of the equipment, the equipment information and the equipment installation information being preset.

According to the present disclosure, it is possible to accurately estimate an amount of refrigerant in an equipment in an actual usage environment without requiring special operation.

BRIEF DESCRIPTION OF THE DRAWINGS

FIG. 3 is an explanatory diagram of temperature measurement points shown in FIG. 2 according to the first embodiment.

FIG. 8 is a diagram showing an example of data items of equipment acquisition data according to the first embodiment.

FIG. 9 is a diagram showing an example of the equipment acquisition data transmitted by the equipment according to the first embodiment.

FIG. 10 is a diagram showing an example of data items of equipment information according to the first embodiment.

FIG. 11 is a diagram showing an example of data items of equipment installation information according to the first embodiment.

DETAILED DESCRIPTION

Hereinafter, embodiments will be described with reference to the drawings.

First Embodiment

First, a first embodiment will be described.

[Overview of Equipment Management System]

Figure 1:
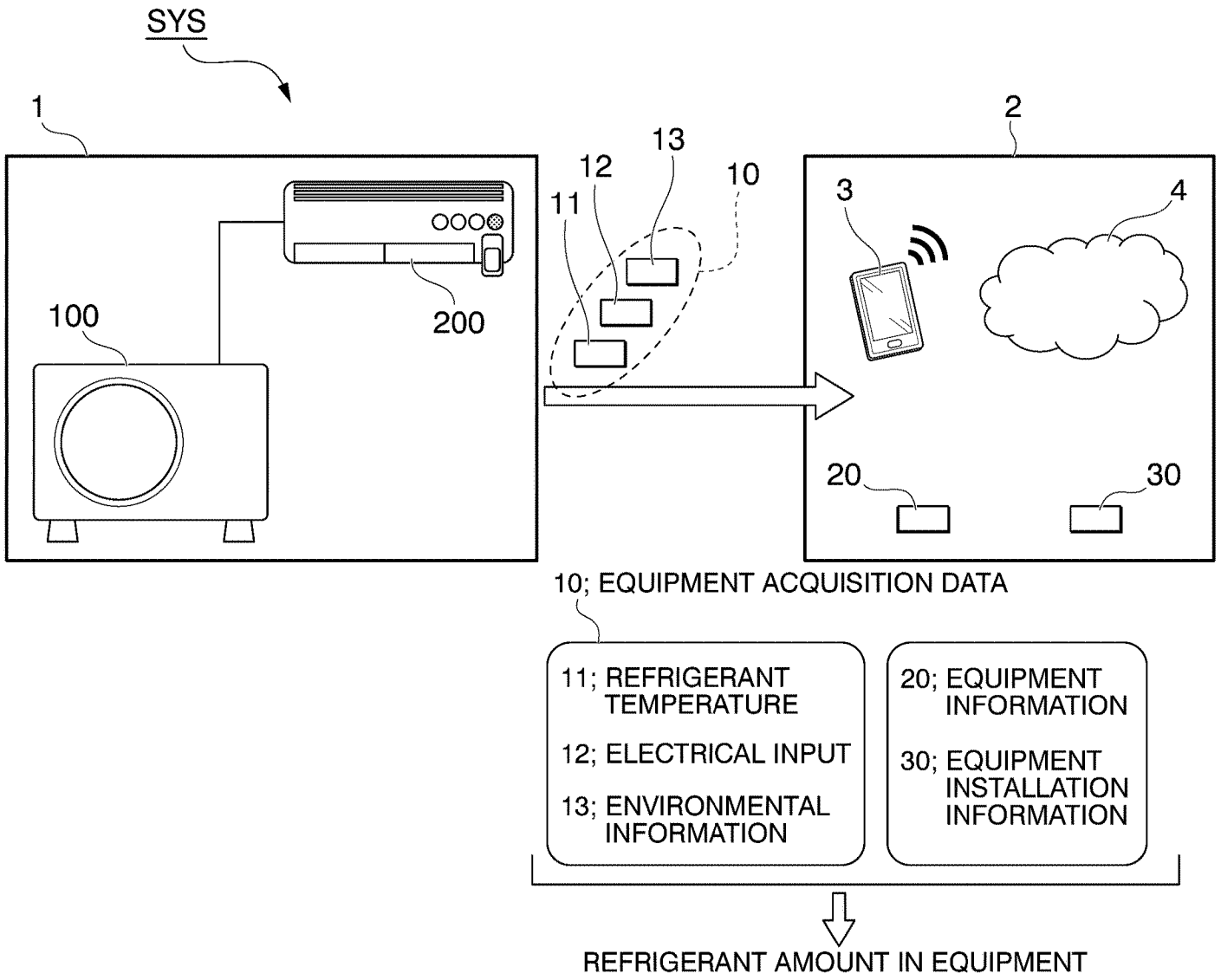
FIG. 1 is a schematic configuration diagram showing an example of an equipment management system according to a first embodiment.

FIG. 1 is a schematic configuration diagram showing an example of an equipment management system according to the present embodiment. An equipment management system SYS shown in this figure includes an equipment 1 having a refrigerant and an equipment management device 2 capable of communicating with the equipment 1. The equipment 1 is, for example, an air conditioner including an outdoor unit 100 and an indoor unit 200. The equipment management device 2 is a data management destination that stores communication data from the equipment 1, and also estimates an amount of refrigerant in the equipment 1. Here, as the equipment management device 2, an external terminal 3 and a cloud 4 are illustrated.

The external terminal 3 is a terminal device such as a smartphone or a PC (Personal Computer). In addition to communicating with the equipment 1, the external terminal 3 may also communicate with the cloud 4 and transmit communication data from the equipment 1 to the cloud 4. The cloud 4 is a group of arithmetic processing devices connected via a communication network such as a public line. The equipment management device 2 may be the external terminal 3 or the cloud 4.

In the equipment management system SYS, the equipment management device 2 such as the external terminal 3 or the cloud 4 communicatively connected to the equipment 1 estimates an amount of refrigerant in the equipment 1, based on equipment acquisition data 10 acquired by the equipment 1, equipment information 20 on the equipment 1, and equipment installation information 30 on an installation environment in which the equipment 1 is installed.

For example, the equipment acquisition data 10 includes measurement information such as a measured value of a refrigerant temperature in the equipment 1 (hereinafter referred to as "refrigerant temperature 11"), a measured value of electrical characteristics in the equipment 1 (hereinafter referred to as "electrical input 12"), and a measured value of environmental information such as a temperature or humidity around the equipment 1 (hereinafter referred to as "environmental information 13"). The equipment 1 transmits the equipment acquisition data 10 to the equipment management device 2.

The equipment management device 2 acquires the equipment acquisition data 10 transmitted from the equipment 1. Further, the equipment management device 2 stores the equipment information 20 and the equipment installation information 30 which are preset. The equipment information 20 includes inspection data before shipping. For example, the equipment information 20 includes: inspection data (steady data or time series data) regarding the refrigerant temperature in the equipment 1 under a specific inspection condition, the electrical characteristics in the equipment 1, or the environmental information; inspection conditions; and specifications (configurations) of the equipment 1 at the time of inspection. The equipment installation information 30 includes an environment, an installation state, or the like of the place where the equipment is installed. Details of the equipment acquisition data 10, the equipment information 20, and the equipment installation information 30 will be described later.

[Configuration of Refrigerant Circuit of Equipment 1]

Figure 2:
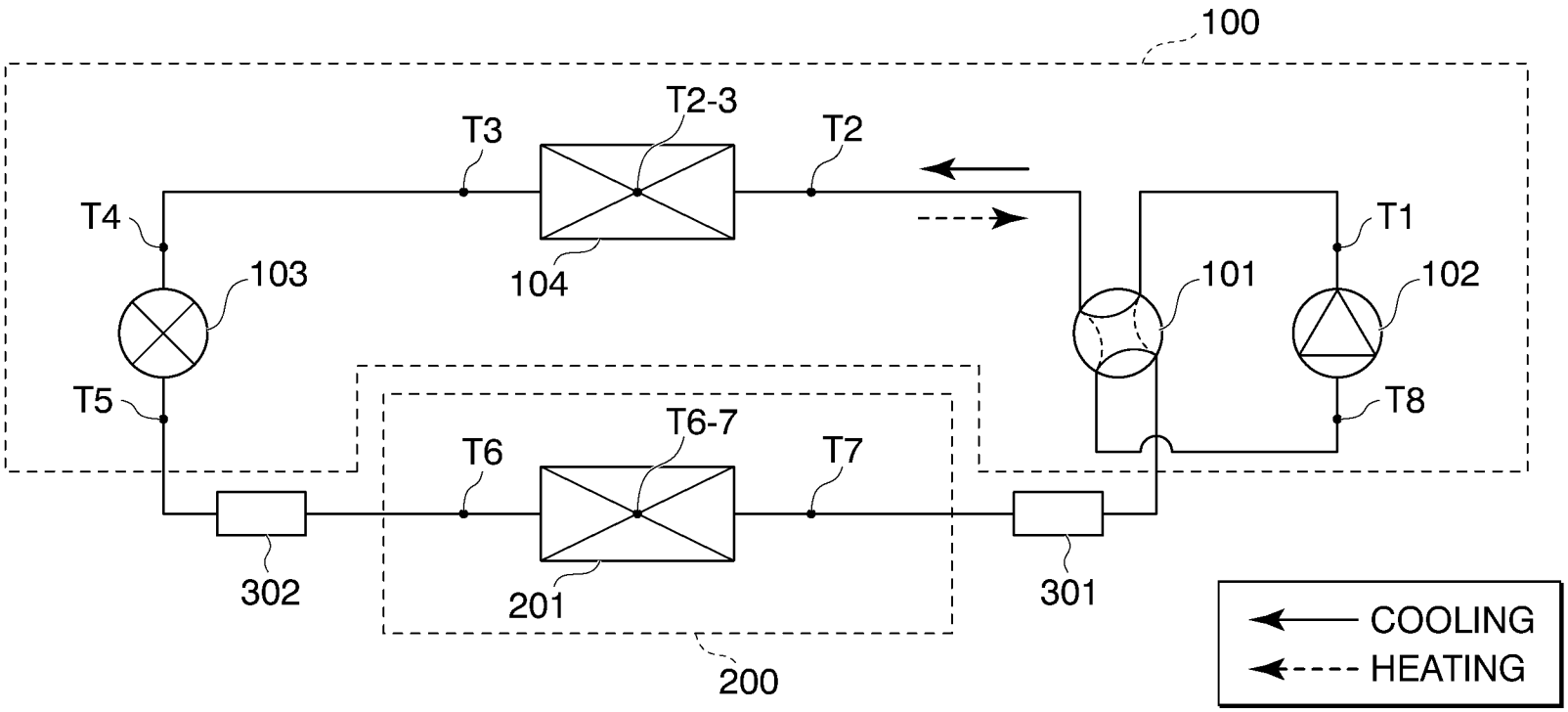
FIG. 2 is a diagram showing an example of a refrigerant circuit of an equipment according to the first embodiment.

FIG. 2 is a diagram showing an example of a refrigerant circuit of the equipment according to the present embodiment. The outdoor unit 100 and the indoor unit 200 are connected by internal-external connection pipes 301 and 302. The refrigerant in a gas state passes through the internal-external connection pipe 301. The refrigerant in a liquid state passes through the internal-external connection pipe 302. By switching a four-way valve 101 provided in the outdoor unit 100 to switch a circulation direction of the refrigerant, heating operation and cooling operation are switched. A direction of a solid line arrow indicates the direction of the refrigerant flow during the cooling operation, and a direction of a broken line arrow indicates the direction of the refrigerant flow during the heating operation.

In the case of heating operation, the refrigerant in the gas state compressed by a compressor 102 of the outdoor unit 100 flows to an indoor heat exchanger 201 of the indoor unit 200 through the four-way valve 101 and the internal-external connection pipe 301. The refrigerant in the indoor heat exchanger 201 exchanges heat with surrounding air to warm the surrounding air. The refrigerant, which has become a liquid state through the heat exchange, flows into an expansion valve 103 of the outdoor unit 100 through the internal-external connection pipe 302, and flows into an outdoor heat exchanger 104 through the expansion valve 103. The refrigerant in the outdoor heat exchanger 104 exchanges heat with the surrounding air. The refrigerant, which has become a gas state through the heat exchange, returns to the compressor 102 through the four-way valve 101.

In the case of cooling operation, the refrigerant in the gas state compressed by the compressor 102 of the outdoor unit 100 flows into the outdoor heat exchanger 104 through the four-way valve 101. The refrigerant in the outdoor heat exchanger 104 exchanges heat with the surrounding air. The refrigerant, which has become a liquid state through the heat exchange, flows into the indoor heat exchanger 201 of the indoor unit 200 through the expansion valve 103 and the internal-external connection pipe 302. The refrigerant in the indoor heat exchanger 201 exchanges heat with the surrounding air to cool the surrounding air. The refrigerant, which has become a gas state through the heat exchange, returns to the compressor 102 of the outdoor unit 100 through the internal-external connection pipe 301 and the four-way valve 101.

The outdoor unit 100 and the indoor unit 200 are each provided with temperature sensors for measuring refrigerant temperatures. FIG. 3 is an explanatory diagram of temperature measurement points T1 to T8 shown in FIG. 2. A temperature sensor is provided on each of an outlet side and an inlet side of the compressor 102, and the measurement point T1 on the outlet side is a measurement point for a discharge temperature, and the measurement point T8 on the inlet side is a measurement point for a suction temperature.

Further, temperature sensors are provided at three points: an outlet side, an inlet side, and an intermediate point between the outlet and the inlet, of each of the expansion valve 103 and the outdoor heat exchanger 104 of the outdoor unit 100 and the indoor heat exchanger 201 of the indoor unit 200. The outdoor heat exchanger 104 functions as a condenser during cooling operation. During cooling operation, the measurement points T2, T2-3, and T3 serve as measurement points for an inlet temperature, an intermediate temperature, and an outlet temperature of the condenser, respectively. On the other hand, the outdoor heat exchanger 104 functions as an evaporator during heating operation. During heating operation, the measurement points T2, T2-3, and T3 serve as measurement points for the outlet temperature, the intermediate temperature, and the inlet temperature of the evaporator, respectively.

The indoor heat exchanger 201 functions as an evaporator during cooling operation. During cooling operation, the measurement points T6, T6-7, and T7 serve as measurement points for an inlet temperature, an intermediate temperature, and an outlet temperature of the evaporator, respectively. On the other hand, the indoor heat exchanger 201 functions as a condenser during heating operation. During heating operation, the measurement points T6, T6-7, and T7 serve as measurement points for the outlet temperature, the intermediate temperature, and the inlet temperature of the condenser, respectively.

Further, the measurement point T4 serves as a measurement point for an inlet temperature of the expansion valve 103 during cooling operation, and a measurement point for an outlet temperature of the expansion valve 103 during heating operation. The measurement point T5 serves as a measurement point for the outlet temperature of the expansion valve 103 during cooling operation, and the measurement point for the inlet temperature of the expansion valve 103 during heating operation.

Note that the equipment 1 may be a multi-type air conditioner (so-called package air conditioner) in which a plurality of indoor units 200 are connected to one outdoor unit 100.

Figure 4:
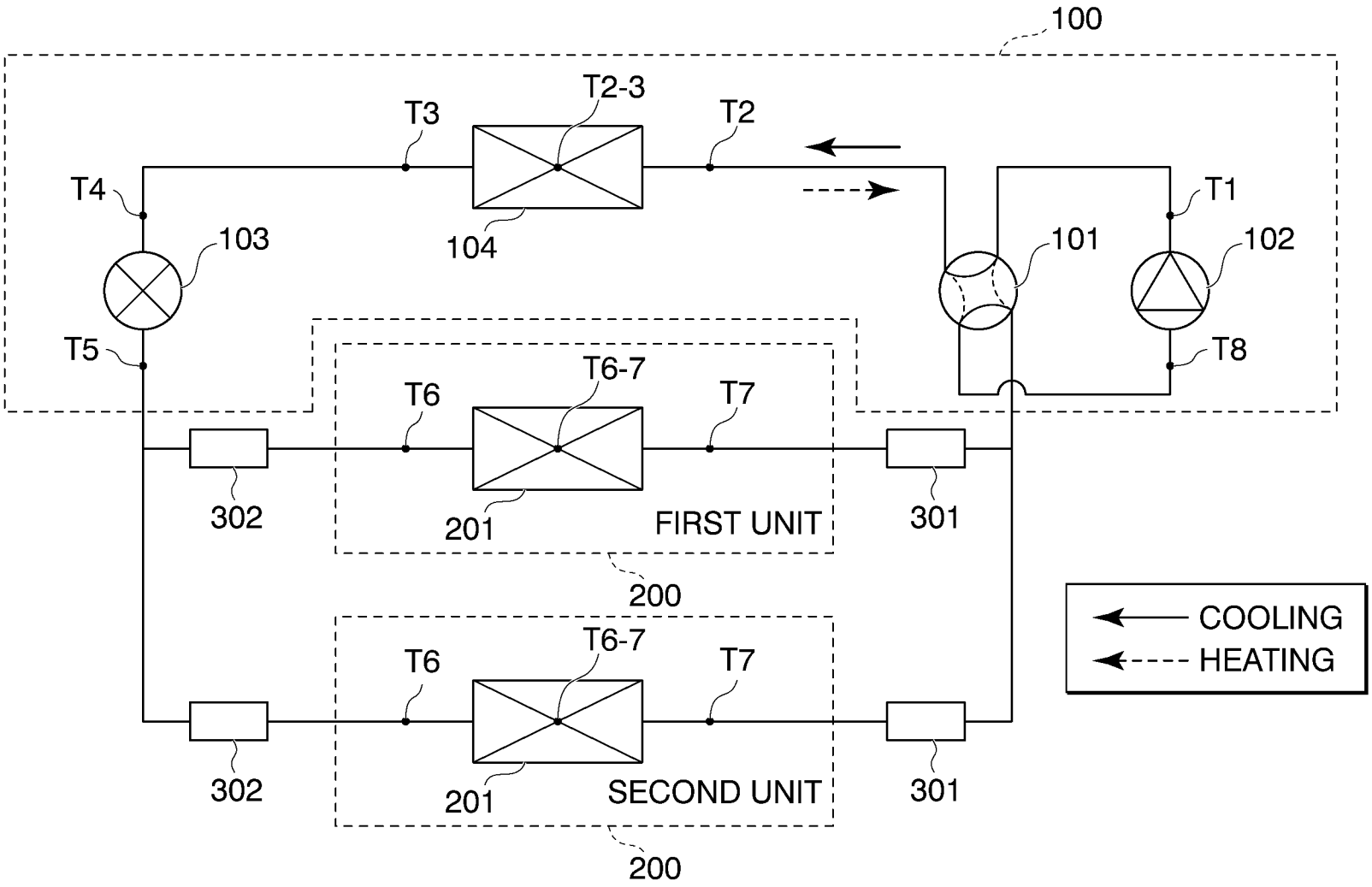
FIG. 4 is a diagram showing an example of a refrigerant circuit of a multi-type air conditioner according to the first embodiment.

FIG. 4 is a diagram showing an example of a refrigerant circuit of a multi-type air conditioner. FIG. 4 shows an example of a refrigerant circuit when two indoor units 200 are connected to the outdoor unit 100. In FIG. 4, the same reference numerals are given to configurations corresponding to the respective components in FIG. 2. A configuration of the illustrated refrigerant circuit is the same as the example of the refrigerant circuit illustrated in FIG. 2, except that the number of indoor units 200 is different. Note that the number of indoor units 200 is not limited to two.

Since the multi-type air conditioner has the plurality of indoor units 200, the indoor units 200 are set with unit numbers such as a first unit, a second unit, . . . , for example. Then, the unit numbers are assigned such as "a discharge temperature of the first unit, an inlet temperature of the condenser, . . . ," and "a discharge temperature of the second unit, an inlet temperature of the condenser, . . . ," and a refrigerant temperature is managed for each unit, distinguishably.

Note that in present embodiment, the number of equipments 1 is basically one for one outdoor unit 100, regardless of whether there is one indoor unit 200 or a plurality of indoor units 200.

Figure 5:
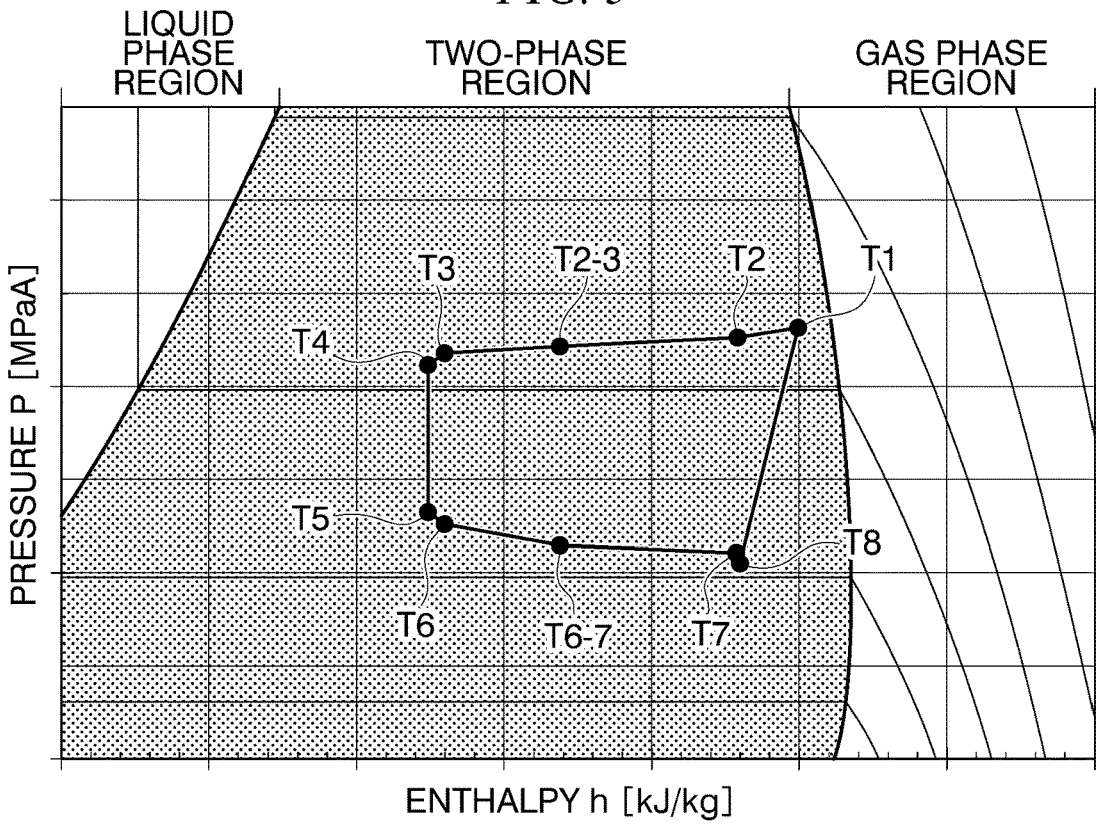
FIG. 5 is a diagram showing an example of a Mollier diagram immediately after startup according to the first embodiment.
Figure 6:
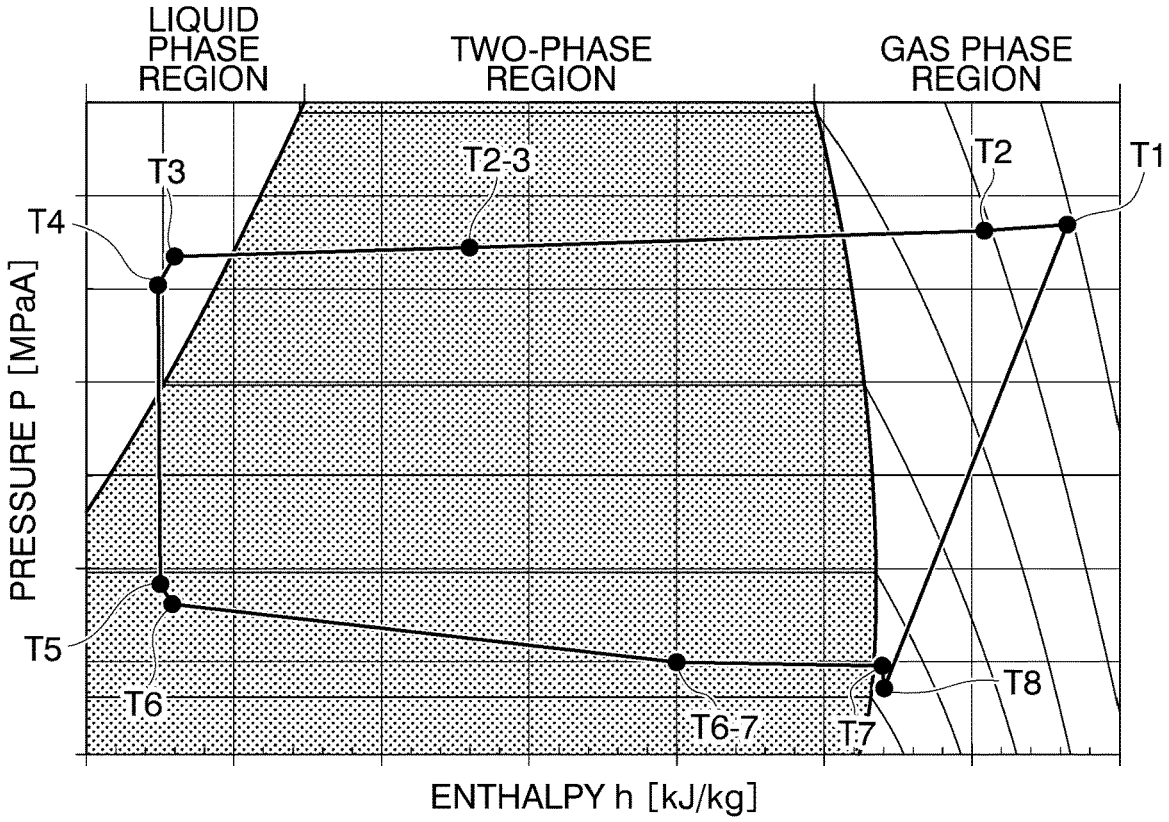
FIG. 6 is a diagram showing an example of a Mollier diagram in a stable state according to the first embodiment.

FIGS. 5 and 6 schematically show examples of Mollier diagrams during cooling operation. FIG. 5 is a diagram showing an example of a Mollier diagram immediately after startup (in an initial stage of operation). FIG. 6 is a diagram showing an example of a Mollier diagram in a stable state. Generally, in the initial stage of operation, all the measurement points T1 to T8 are in a gas-liquid two-phase region (two-phase region) (see FIG. 5). Thereafter, as the refrigerant gas is gradually compressed by the compressor 102, a pressure difference between the condenser and the evaporator increases, and at the measurement point T1 for the discharge temperature, it is gasified and transitions into a gas phase region (see FIG. 6). Further, at the measurement point T3 for the outlet temperature of the condenser, the enthalpy decreases through heat exchange with the air by the condenser. If an amount of refrigerant gas and an amount of heat exchanged by the condenser are sufficient, the measurement point T3 transitions into a liquid phase region (see FIG. 6). On the other hand, if the amount of refrigerant gas is insufficient, the heat exchange by the condenser and the evaporator will be insufficient.

[Configuration of Electric Circuit of Equipment 1]

Next, an example of a main electric circuit of the equipment 1 will be described with reference to FIG. 7.

Figure 7:
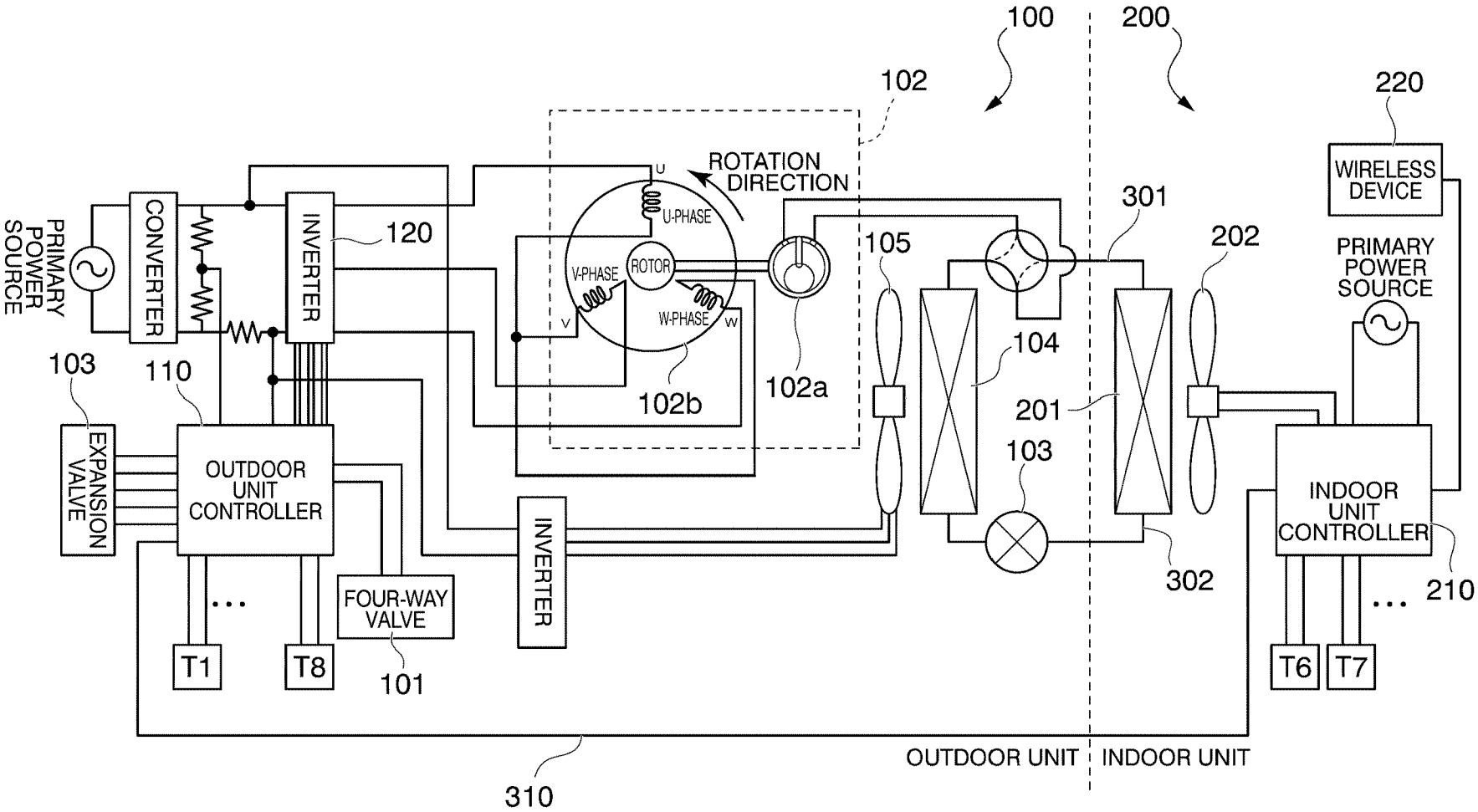
FIG. 7 is a diagram showing an example of an electric circuit of the equipment according to the first embodiment.

FIG. 7 is a diagram showing an example of the electric circuit of the equipment 1 according to the present embodiment. In FIG. 7, the same reference numerals are given to configurations corresponding to the respective components in FIG. 2.

The outdoor unit 100 includes an outdoor unit controller 110. The outdoor unit controller 110 is configured to include a microcomputer, controls each component of the outdoor unit 100, and acquires measurement values of various sensors provided in the outdoor unit 100. For example, the outdoor unit controller 110 acquires a measured value of the temperature sensor provided at each of the refrigerant temperature measurement points T1, T2, T2-3, T3, T4, T5, and T8 described with respect to FIGS. 2 and 3.

Further, the outdoor unit controller 110 also performs controlling switching of the flow direction of the refrigerant in the four-way valve 101, controlling the compressor 102, controlling an opening degree of the expansion valve 103, controlling the rotation of an outdoor fan 105 that blows air to the outdoor heat exchanger 104, and the like.

The compressor 102 includes a compression unit 102*a* and a compressor motor 102*b*. The compression unit 102*a* has a compression mechanism such as a rotary type or a scroll type, compresses the refrigerant sucked in from the inlet side, and discharges it from the outlet side. The compressor motor 102*b* includes a three-phase motor whose rotation can be controlled by an inverter 120, and drives the compression mechanism of the compression unit 102*a*. The outdoor unit controller 110 controls the rotation of the compressor motor 102*b* by controlling the inverter 120, thereby controlling the compression mechanism of the compression unit 102*a*.

The indoor unit 200 includes an indoor unit controller 210. The indoor unit controller 210 is configured to include a microcomputer, controls each component of the indoor unit 200, and acquires measurement values of various sensors provided in the indoor unit 200. For example, the indoor unit controller 210 acquires a measured value of the temperature sensor provided at each of the refrigerant temperature measurement points T6, T6-7, and T7 described with respect to FIGS. 2 and 3. Further, the indoor unit controller 210 performs controlling the rotation of an indoor fan 202 that blows air to the indoor heat exchanger 201, and the like.

Further, the indoor unit 200 includes a wireless device 220. The wireless device 220 is, for example, one of equipment accompanying devices added to the indoor unit 200 as options. The wireless device 220 connects to a communication network such as a wireless LAN (Local Area Network) or the Internet by wireless communication, and performs data communication with the equipment management device 2 (external terminal 3 or cloud 4).

The indoor unit controller 210 is connected to the outdoor unit controller 110 via an internal-external communication line 310. The indoor unit controller 210 generates the equipment acquisition data 10 based on data acquired from the outdoor unit controller 110 via the internal-external communication line 310 and data acquired by the indoor unit controller 210 itself. Then, the indoor unit controller 210 transmits the equipment acquisition data 10 to the equipment management device 2 (external terminal 3 or cloud 4) via the wireless device 220.

Here, in conventional air conditioners, it is necessary to acquire various refrigerant temperatures or pressures from the air conditioners when a frequency of the compressor is fixed and the refrigeration cycle is stable. This is because when estimating an amount of refrigerant, in order to accurately estimate the mass of the refrigerant in the liquid phase region and the gas-liquid two-phase region, due to the characteristics of the refrigeration cycle, it is necessary to grasp a pressure of the condenser in the gas-liquid two-phase region and a subcooling area on the outlet side of the condenser.

That is, in the conventional air conditioners, it has been possible to estimate the amount of refrigerant when the air conditioning loads of the outdoor unit and the indoor unit are constant, the compressor frequency is constant, and the refrigeration cycle is stable.

However, an environment for air conditioners where the air conditioning loads on the outdoor unit and the indoor unit are constant, such as in a test room, does not exist in reality. For example, when focusing on the outdoor unit, the air conditioning load applied to the outdoor unit changes as the outside temperature is not constant throughout the day. Further, when focusing on the indoor unit, the air conditioning load applied to the indoor unit changes depending on the number of people in the room or their activity status.

Therefore, generally, when controlling the compressor of an air conditioner to maintain a constant indoor temperature (or constant humidity), the compressor frequency changes variably, and therefore it has been difficult to estimate the amount of refrigerant when considering the actual usage environment. Therefore, special operation has been required to estimate the amount of refrigerant.

Further, in the conventional technology, in order to estimate the amount of refrigerant, it is necessary to define parameters through experiments, numerical simulations, or the like, and it is necessary to perform a complete evaluation depending on the number of specifications of an equipment. Therefore, there is also a problem that development costs increase. On the other hand, when the specifications of the equipment are defined to be a universally common model, there is also a problem that the accuracy of estimating the amount of refrigerant decreases.

Therefore, as described with reference to FIG. 1, in the present embodiment, the equipment management device 2 (external terminal 3 or cloud 4) communicatively connected to the equipment 1 estimates an amount of refrigerant in the equipment 1, based on the equipment acquisition data 10, the equipment information 20, and the equipment installment information 30. As a result, the equipment management system SYS can accurately estimate an amount of refrigerant in the equipment 1 in an actual usage environment without requiring any special operation. Detailed description is given below.

[Specific Example of Equipment Acquisition Data]

First, a specific example of data items included in the equipment acquisition data 10 will be described.

FIG. 8 is a diagram showing an example of data items of the equipment acquisition data 10 according to the present embodiment. As described above, the equipment acquisition data 10 includes the refrigerant temperature 11, the electrical input 12, and the environmental information 13.

Examples of the refrigerant temperature 11 include a discharge temperature, a temperature at any point from the inlet to the outlet of the condenser and the evaporator (e.g., inlet temperature, intermediate temperature, outlet temperature), and a temperature of the expansion valve 103 (e.g., inlet temperature, outlet temperature), a suction temperature, and the like. Note that the refrigerant temperature 11 may include the temperatures at all or some of the above points. When the refrigerant temperature 11 includes some of the above, it is preferable that at least the discharge temperature is included. Further, when the refrigerant temperature 11 does not include all of the inlet temperature, the intermediate temperature, and the outlet temperature of the condenser and the evaporator, it is preferable that at least the intermediate temperature is included.

Note that temperature sensors may also be provided in the internal-external connection pipes 301 and 302, and a temperature of the internal-external connection pipe 301 (for example, inlet temperature and outlet temperature) may be included in the refrigerant temperature 11. Further, the refrigerant temperature 11 is not limited to the temperature at the above-described points, and may include a refrigerant temperature at any point which the equipment 1 can acquire. As measurement values of refrigerant temperatures at the more points are included in the refrigerant temperature 11, the accuracy of estimating the amount of refrigerant increases.

Examples of the electrical input 12 includes a voltage (bus voltage, line voltage, phase voltage), a current (bus current, line current, phase current), and a rotation speed (current rotation speed, command rotation speed), power consumption, and the like of the outdoor fan 105 and the indoor fan 202. Examples of the electrical input 12 further includes a voltage (bus voltage, line voltage, phase voltage), a current (bus current, line current, phase current), a frequency (current frequency, command frequency), and power consumption, and the like of the compressor 102. Examples of the electrical input 12 further includes an opening degree (current opening degree, command opening degree), power consumption, and the like of the expansion valve 103. Examples of the electrical input 12 further includes a voltage (primary voltage) and a current (primary current) on a power supply side, and power consumption of the equipment accompanying devices (e.g., wireless device 220, heater, air purifying device, etc.).

Note that when the voltage, current, or power of the outdoor fan 105, the indoor fan 202, or the compressor 102 cannot be directly acquired, the power consumption of the equipment accompanying devices is used to estimate the unacquirable voltage, current, or power by indirect method from a total sum of that of the entire equipment 1.

Note that the electrical input 12 may include all or some of the above data items. For example, it is preferable that the electrical input 12 includes at least the rotation speed (current rotation speed) of the outdoor fan 105 and the indoor fan 202, the bus current and the current frequency of the compressor 102, and the current opening degree of the expansion valve 103.

Note that, in addition to the above data items, the electrical input 12 may include any electrical characteristics in the equipment 1, which can be acquired by the equipment 1. As the more data items are included in electrical input 12, the accuracy of estimating the refrigerant amount increases.

Examples of the environmental information 13 include an ambient temperature (outdoor temperature, indoor temperature) and an ambient humidity (outdoor humidity, indoor humidity) acquired by the outdoor unit 100 and the indoor unit 200. Note that the environmental information 13 may include all or some of the above data items. For example, it is preferable that the environmental information 13 includes at least the indoor temperature.

Note that in addition to the data items described above, the environmental information 13 may include environmental information that can be acquired by the equipment 1. As the more data items are included in the environmental information 13, the accuracy of estimating the amount of refrigerant increases.

The equipment 1 transmits the equipment acquisition data 10 described with reference to FIG. 8 to the equipment management device 2. FIG. 9 is a diagram showing an example of the equipment acquisition data 10 transmitted by the equipment 1. For example, as shown in FIG. 9, the equipment 1 transmits time-series data of the equipment acquisition data 10 measured at regular time intervals. Note that when transmitting the equipment acquisition data 10, the equipment 1 may transmit data at a fixed point under a certain condition.

[Specific Example of Equipment Information]

Next, a specific example of data items included in the equipment information 20 will be explained.

FIG. 10 is a diagram showing an example of the data items of the equipment information 20 according to the present embodiment. As described above, the equipment information 20 includes pre-shipment inspection data, inspection conditions, and specifications (configurations) of the equipment 1 at the time of inspection.

In FIG. 10, the common items include the specifications (configurations) of the equipment 1 at the time of inspection. Examples of the common items include an inspection date and time (No. 1), a testing room used for the inspection (No. 2), manufacturing information and product specifications of the inspected equipment 1, and the like. The manufacturing information includes a lot number (No. 3), a manufacturing year (No. 6), and the like. The product specifications include a model (No. 4) and the capacity (No. 5) of the equipment 1, as well as a power supply specification, a refrigerant type and a charged amount, a type of refrigerating machine oil and an oil amount, a model of the compressor 102, a stroke volume, a specification of the compressor motor 102*b*, an internal volume of the compressor 102, an internal volume of the outdoor heat exchanger 104, an internal volume of the indoor heat exchanger 201, an internal volume of a receiver (No. 7 to No. 18), and the like.

Note that the receiver is provided, for example, near a connection portion between the expansion valve 103 of the outdoor unit 100 and the internal-external connection pipe 302. This receiver is provided to store surplus refrigerant since there is a difference in the required amount of refrigerant between cooling operation and heating operation. Generally, the internal volume of the outdoor unit 100 is larger than that of the indoor unit 200, and the amount of refrigerant in the indoor unit 200 which serves as a condenser during heating operation is reduced compared to when the outdoor unit 100 is in cooling operation.

Further, the pre-shipment inspection data includes a refrigerant temperature in the equipment 1 under specific inspection conditions, electrical characteristics in the equipment 1, inspection data (steady data or time-series data) of the environmental information, and the like.

In this FIG. 10, among the inspection data items, item No. 1 to item No. 5 are common inspection conditions, regardless of the type of the equipment 1. These common inspection conditions include a test condition (for example, cooling standard or heating standard), an outdoor DB (Dry Bulb), an outdoor WB (Wet Bulb), an indoor DB, an indoor WB, and the like.

Further, among the inspection data items, item No. 8 to item No. 11 are inspection conditions that differ for each equipment or each capacity range of the equipment, and include equipment control settings at the time of inspection which individually differ, such as a command frequency of the compressor 102, a command rotation speed of the indoor fan 202 and the outdoor fan 105, a command opening degree of the expansion valve 103, and the like.

Further, among the inspection data items, item No. 6, item No. 7, and item No. 12 to item No. 19 are inspection data (steady data or time series data) under the above-described inspection conditions. Examples of the inspection data include capacity (indoor capacity) and power consumption of the indoor unit 200, thermal characteristics and a discharge temperature of the outdoor heat exchanger 104 and the indoor heat exchanger 201, an inlet temperature, outlet temperature, and a suction temperature of the condenser and the evaporator, and the like.

Note that the equipment information 20 may include all or some of the above data items. For example, it is preferable that the equipment information 20 includes at least the type of refrigerant and the volume of space through which the refrigerant can flow. The volume of the space through which the refrigerant can flow includes the internal volume of the compressor 102, the internal volume of the outdoor heat exchanger 104, the internal volume of the indoor heat exchanger 201, the internal volume of the receiver, and the like. Note that the volume of the space through which the refrigerant can flow may include all or some of the internal volume of the compressor 102, the internal volume of the outdoor heat exchanger 104, the internal volume of the indoor heat exchanger 201, and the internal volume of the receiver.

Note that in addition to the above data items, the equipment information 20 may also include any information measurable at the time of inspection. As the more data items are included in the equipment information 20, the accuracy of estimating the amount of refrigerant increases.

Further, in addition to a 100% inspection, a sampling inspection is generally performed when shipping a product, and in the sampling inspection, for example, the most recent lot is used as a representative value.

[Specific Example of Equipment Installation Information]

Next, a specific example of data items included in the equipment installation information 30 will be described.

FIG. 11 is a diagram showing an example of the data items of the equipment installation information 30 according to the present embodiment. As described above, the equipment installation information 30 includes information such as an installation location or an installation environment of the equipment 1.

Examples of the equipment installation information 30 include, as information on an installation location or an installation environment, a position of the installation location of the equipment 1 (latitude, longitude), building specifications, an installation direction (north, south, etc.), an installation method of the outdoor unit 100 (on a roof, on the ground, on a ceiling, on a wall surface, etc.), a height of the indoor unit 200 (height from the floor), a size of the indoor space, lengths and diameters of the internal-external connection pipes 301 and 302 that connect the outdoor unit 100 and the indoor unit 200, a height difference between the outdoor unit 100 and the indoor unit 200 (indoor-outdoor height difference), and the like. Here, the building specifications are elements necessary to define insulation performance of the building itself, such as a wooden structure, a reinforced concrete, a condominium, or a single-family house, and are parameters necessary to calculate a load on the indoor unit 200. Further, the indoor-outdoor height difference is a height difference between a position where the internal-external connection pipes 301 and 302 are connected to the outdoor unit 100 and a position where the internal-external connection pipes 301 and 302 are connected to the indoor unit 200.

Note that the equipment installation information 30 may include all or some of the above data items. For example, it is preferable that the equipment installation information 30 includes the lengths and diameters of the internal-external connection pipes 301 and 302, which are related to the volume of the space through which the refrigerant can flow.

Note that the equipment installation information 30 may include any information other than the above data items regarding the environment or installation state of the installation location. As the more data items are included in the equipment installation information 30, the accuracy of estimating the amount of refrigerant increases.

For example, the installation location or installation environment of the equipment 1 differs depending on a user. If the installation location or installation environment is different, the estimation of the amount of refrigerant will also be affected. For example, regarding the installation location of the equipment 1, when the outdoor unit 100 is installed on the first floor, the height of the indoor unit 200 relative to that of the outdoor unit 100 generally differs by about 5 m between when the indoor unit 200 is installed on the first floor and when the indoor unit 200 is installed on the third floor. Therefore, even if the amount of refrigerant in the equipment 1 excluding the internal-external connection pipes 301 and 302 is the same, the lengths of the internal-external connection pipes 301 and 302 are different, so that it is assumed that different behaviors will occur in the refrigeration cycle. Therefore, the installation location of the equipment 1 may affect the estimation of the amount of refrigerant.

Note that even if the height difference between the outdoor unit 100 and the indoor unit 200 is the same, the lengths of the internal-external connection pipes 301 and 302 may differ. In that case, since the refrigerant is distributed in the internal-external connection pipes 301 and 302, if the additional refrigerant is not charged for the lengths of the internal-external connection pipes 301 and 302, the amount of refrigerant in the equipment 1 excluding the internal-external connection pipes will be reduced in total, so that there may be a gas shortage. Regarding the installation environment of the equipment 1, the lengths of the internal-external connection pipes 301 and 302 differ depending on whether the outdoor unit 100 is mounted on the ceiling, placed on the ground, or placed on the roof. Further, even when the outdoor unit 100 is placed on the same ground, the air conditioning load is different depending on whether it is facing south and is exposed to direct sunlight, or it is facing north and is in the shade, so that it affects the refrigeration cycle. Therefore, the installation environment of the equipment 1 may similarly affect the estimation of the amount of refrigerant.

Further, regarding the installation environment of the equipment 1, the insulation performance differs depending on whether the building in which the equipment 1 is installed is made of wood or reinforced concrete. For example, if the building is made of wood and has low insulation performance, the air conditioning load will be large, so that it may affect the refrigeration cycle and also the estimation of the amount of refrigerant.

Therefore, by using the equipment installation information 30, the equipment management device 2 can estimate the amount of refrigerant according to the installation location or the installation environment of the equipment 1, without fixing the installation location or the installation environment of the equipment 1.

Next, a configuration of the equipment management device 2 and an operation of refrigerant amount estimation processing of estimating an amount of refrigerant will be described.

Figure 12:
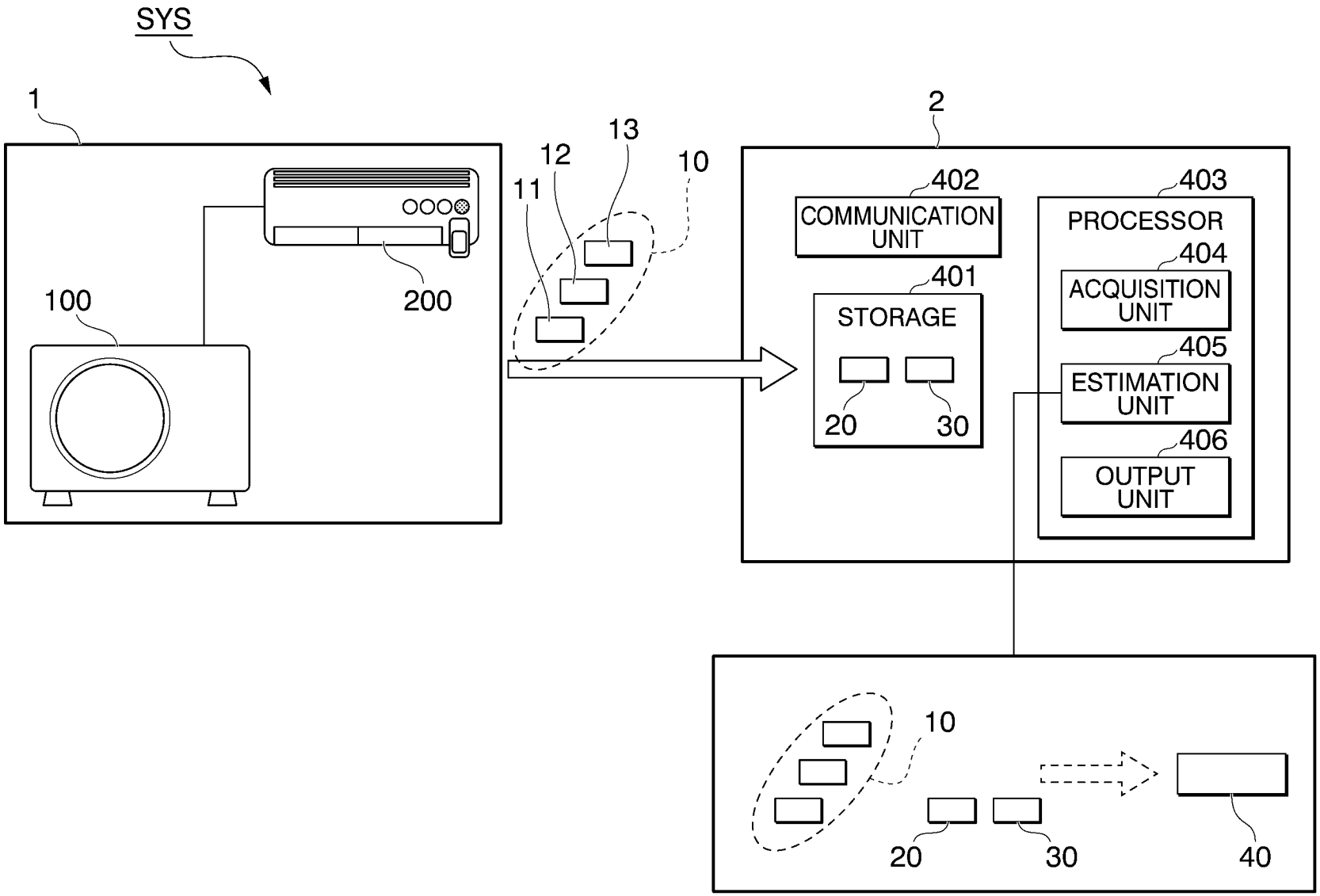
FIG. 12 is a schematic block diagram showing an example of a configuration of an equipment management device according to the first embodiment.

FIG. 12 is a schematic block diagram showing an example of the configuration of the equipment management device 2 according to the present embodiment. As described above, the equipment management device 2 is the external terminal 3 or the cloud 4, and includes, for example, a storage 401, a communication unit 402, and a processor 403.

The storage 401 stores a control program for controlling each component of the equipment management device 2, various data, and the like. For example, the storage 401 is configured to include a DRAM (Dynamic Random Access Memory), an EEPROM (Electrically Erasable Programmable Read Only Memory), a flash ROM, an HDD (Hard Disk Drive), an SSD (Solid State Drive), and the like. For example, the equipment information 20 (see FIG. 10) and the equipment installation information 30 (see FIG. 11) are stored in advance in the storage 401.

The communication unit 402 performs data communication with the equipment 1 or other equipments by wireless communication. For example, the communication unit 402 connects to a communication network such as a wireless LAN (Local Area Network) or the Internet through wireless communication, and performs data communication with the equipment 1 or other equipments. Note that the communication unit 402 may also support wired communication.

The processor 403 includes an acquisition unit 404, an estimation unit 405, and an output unit 406, as a functional configuration that performs the refrigerant amount estimation processing of estimating an amount of refrigerant by a CPU (Central Processing Unit) executing the control program stored in the storage 401. The acquisition unit 404 acquires the equipment acquisition data 10 (see FIG. 8) from the equipment 1 (for example, the indoor unit 200) via the communication unit 402, and causes the storage 401 to store the acquired equipment acquisition data 10. The estimation unit 405 estimates an amount of refrigerant in the equipment 1. Here, the estimated amount of refrigerant is referred to as "estimated refrigerant amount 40." For example, the estimation unit 405 calculates the estimated refrigerant amount 40 in the equipment 1 based on the equipment acquisition data 10 acquired by the acquisition unit 404, and the equipment information 20 and the equipment installation information 30 which are stored in the storage 401. The output unit 406 outputs a result of the refrigerant amount estimation by the estimation unit 405.

Figure 13:
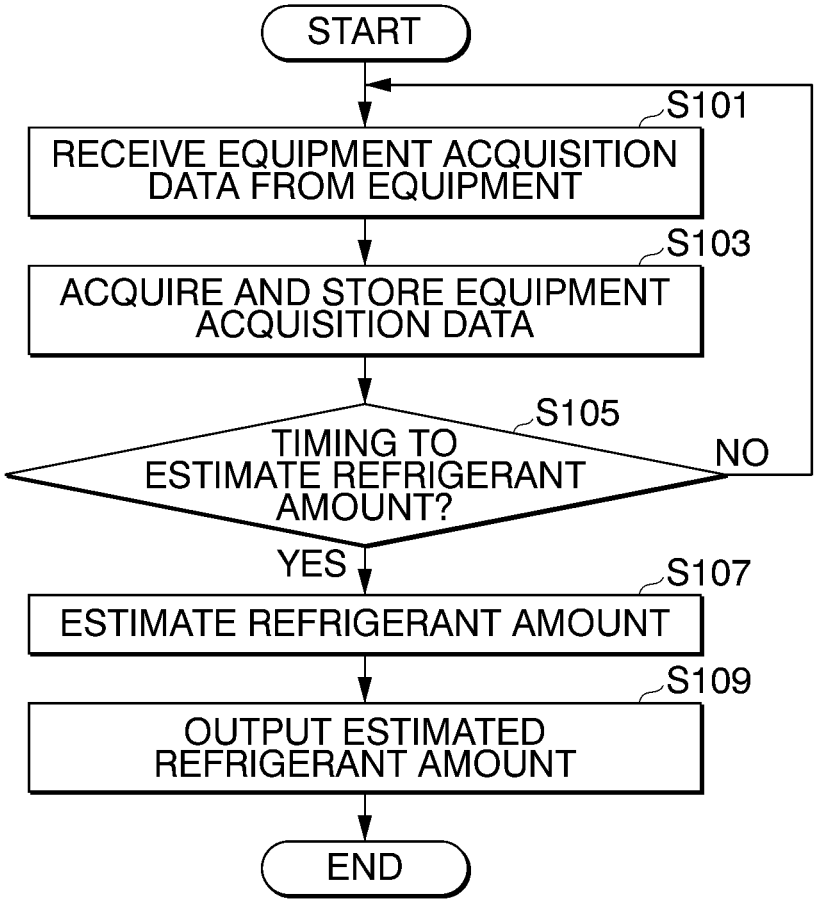
FIG. 13 is a flowchart showing an example of refrigerant amount estimation processing according to the first embodiment.

Next, with reference to FIG. 13, the operation of the refrigerant amount estimation processing performed in the equipment management system SYS will be described in detail. FIG. 13 is a flowchart showing an example of the refrigerant amount estimation processing according to the present embodiment.

The equipment 1 (for example, the indoor unit 200) periodically (for example, every 5 minutes) transmits the equipment acquisition data 10 to the equipment management device 2, either voluntarily by the equipment 1 or passively by a user operating the equipment 1. The equipment management device 2 receives the equipment acquisition data 10 transmitted from the equipment 1 (step S101).

When the equipment management device 2 receives the equipment acquisition data 10 transmitted from the equipment 1, the equipment management device 2 acquires the equipment acquisition data 10 each time it is received, and stores and accumulates the equipment acquisition data 10 in the storage 401 (step S103).

Further, the equipment management device 2 estimates an amount of refrigerant in the equipment 1 at any timing in addition to internal regular processing. The equipment management device 2 determines whether or not it is the timing to estimate an amount of refrigerant (step S105). If it is not the timing to estimate an amount of refrigerant (NO), the equipment management device 2 returns to step S101, and periodically receives the equipment acquisition data 10 from the equipment 1 (step S103).

If it is the timing to estimate an amount of refrigerant (YES), the equipment management device 2 estimates an amount of refrigerant in the equipment 1 (step S107). Specifically, the equipment management device 2 calculates the estimated refrigerant amount 40 based on the accumulated equipment acquisition data 10, and the equipment information 20 and the equipment installation information 30 which are stored internally in advance. Then, the equipment management device 2 outputs the estimated refrigerant amount (estimated refrigerant amount 40) (step S109).

Figure 14:
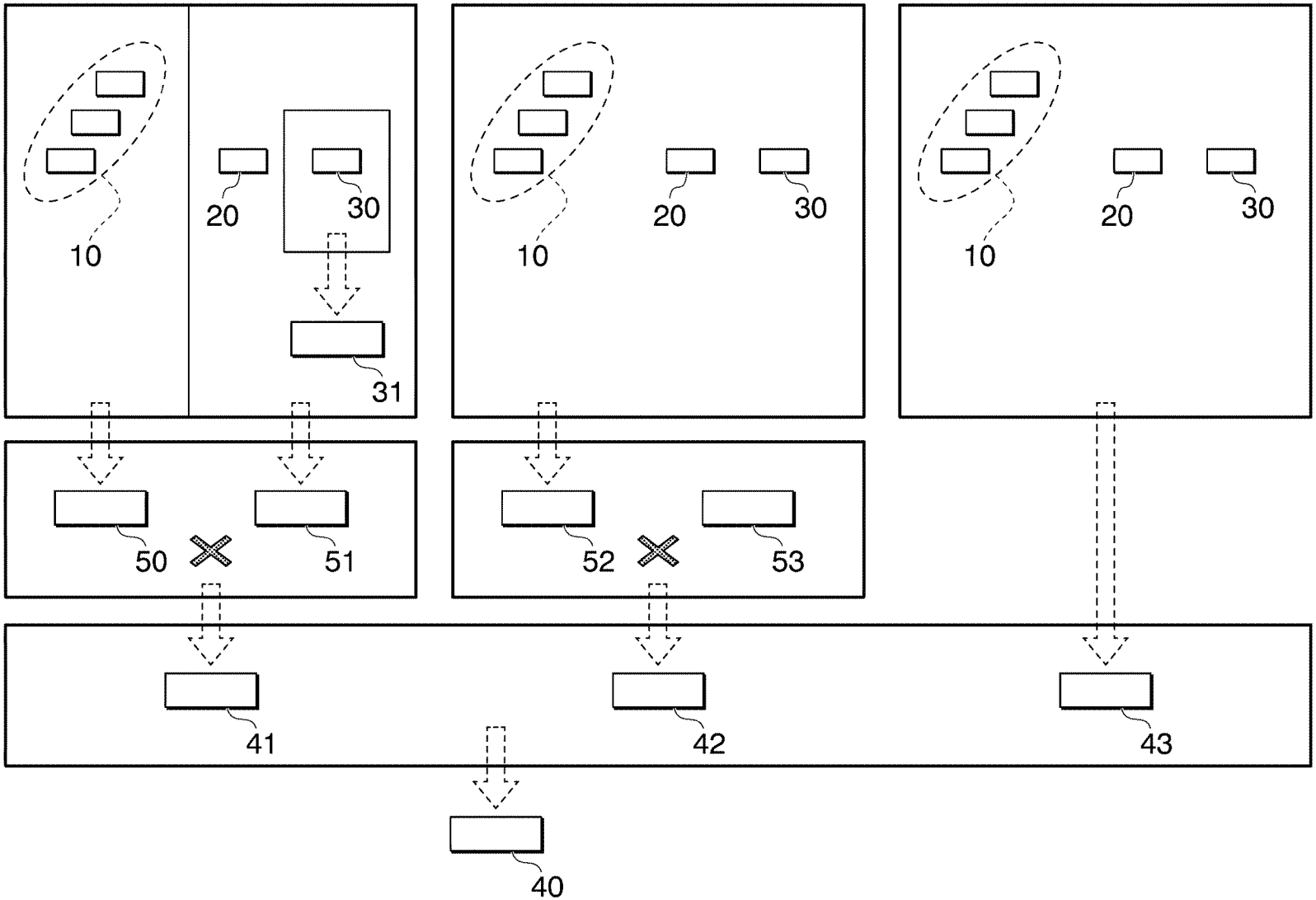
FIG. 14 is an explanatory diagram showing an example of a method of calculating an estimated refrigerant amount according to the first embodiment.

Here, with reference to FIG. 14, a method of calculating the estimated refrigerant amount 40 will be described in detail. FIG. 14 is an explanatory diagram showing an example of the method of calculating the estimated refrigerant amount according to the present embodiment. As shown in this figure, the equipment management device 2 calculates the estimated refrigerant amount 40 based on a sum of a converted refrigerant amount 41, a dissolved refrigerant amount 42, and a retained refrigerant amount 43, for example. Note that other than using the calculated value, the estimated refrigerant amount 40 may be directly set if it can be determined from refrigerant charging work or the like.

The converted refrigerant amount 41 is an amount of refrigerant in a main refrigerant state in each component constituting the equipment 1. For example, when a volume ratio of the gas phase to the liquid phase at the inlet of the condenser is 95:5, the converted refrigerant amount 41 indicates the amount of refrigerant in the gas phase portion. On the other hand, when the volume ratio of the gas phase to the liquid phase at the inlet of the condenser is 5:95, the converted refrigerant amount 41 indicates the amount of refrigerant in the liquid phase portion. Further, when the volume ratio of the gas phase to the liquid phase at the inlet of the condenser is the same, the converted refrigerant amount 41 indicates the refrigerant amount using the two-phase average density. For example, the converted refrigerant amount 41 is calculated by multiplying the internal volume of each component of the equipment 1 by the refrigerant density. For example, as shown in FIG. 14, the converted refrigerant amount 41 is calculated by a product of an internal volume 31 of the internal-external connection pipes 301 and 302 determined from the equipment installation information 30 (lengths and diameters of the internal-external connection pipes 301 and 302), an internal volume 51 of each component of the equipment 1 which is included in the equipment information 20, and a refrigerant density 50 in each component.

Here, the refrigerant density in each component can be determined from a relationship between pressure and density by converting the refrigerant temperature of the equipment acquisition data 10 into pressure. The relationship between pressure and density is predetermined by the type of refrigerant. Note that if the refrigerant pressure data can be directly acquired from the equipment 1, it can be determined based on the acquired refrigerant pressure data or pressure data. Each component described here is a component that has a space through which the refrigerant can flow among the components that constitute the equipment 1, and is, for example, the compressor 102, the outdoor heat exchanger 104, the indoor heat exchanger 201, the receiver, the internal-external connection pipes 301 and 302, or the like.

The dissolved refrigerant amount 42 is an amount of refrigerant dissolved in a refrigerating machine oil used in the equipment 1. For example, as shown in FIG. 14, the dissolved refrigerant amount 42 is calculated by a sum of products of a retained oil amount 52 of each component and an oil dissolution ratio 53 of each component. Here, the total amount of oil in the equipment 1 is a value of the oil amount in the equipment information 20 shown in FIG. 10. Of the amount of oil in the equipment 1, the retained oil amount 52 remaining in each component is determined by experiment or numerical calculation, for each operating condition (cooling, heating, etc.), based on the equipment acquisition data 10, the equipment information 20, and the equipment installation information 30. For example, the equipment information 20 further includes the retained oil amount 52 in each component determined by this experiment or numerical calculation.

Further, the oil dissolution ratio 53 of each component can be calculated using a Daniel chart showing the amount of refrigerant dissolved in the refrigerating machine oil according to the temperature and pressure measured by an experimental method. For example, the current oil dissolution ratio 53 of each component can be calculated using the Daniel chart and a measured value of the refrigerant temperature of each component included in the equipment acquisition data 10. When calculating it using the Daniel chart, it may be calculated using an approximate formula.

Note that the retained oil amount 52 of each component may be determined only for components that have a large internal volume and tend to retain the refrigerating machine oil, and components that have a small amount of retained refrigerating machine oil may be excluded. For example, the refrigerating machine oil tends to remain in the compressor 102, the outdoor heat exchanger 104, and the indoor heat exchanger 201 in large amounts.

The retained refrigerant amount 43 is an amount of refrigerant that remains in liquid form in each component (receiver, internal-external connection pipes 301 and 302, etc.) in the gas-liquid two-phase region. If the cross-sectional area of a refrigerant flow path of each component is small, the refrigerant flow rate will be high, making it difficult for the refrigerant to remain, and if the cross-sectional area is large, the refrigerant flow rate will be slow, making it easier for the refrigerant to remain. Therefore, as shown in FIG. 14, for example, the retained refrigerant amount 43 can be determined by experiment or numerical calculation, based on the equipment acquisition data 10, the equipment information 20, and the equipment installation information 30, according to the cross-sectional area of the refrigerant flow path of each component and the flow rate of the refrigerant circulating in the equipment 1.

Note that mainly among the components that have height differences, downstream components have a large amount of liquid retention, and therefore the other components may be excluded. Further, the retained refrigerant amount 43 is targeted for transient phenomena in the refrigeration cycle, and can be ignored when the refrigeration cycle is stable.

Further, the flow rate of refrigerant circulating in the equipment 1 is determined by a frequency of the compressor 102 and a suction refrigerant density. The suction refrigerant density can be uniquely determined by the amount of heat exchange between the condenser and the evaporator in the equipment 1. Note that it can also be determined from the suction temperature or pressure acquired by the equipment 1.

Further, the amount of heat exchange between the condenser and the evaporator is determined by the outdoor or indoor environmental load, and can be determined from the equipment acquisition data 10 and the equipment installation information 30 in this case.

As described above, in the equipment management system SYS according to the present embodiment, the equipment management device 2 is configured to acquire the equipment acquisition data 10 (measurement information) indicating a result of measuring a temperature of a refrigerant in the equipment 1, an electrical input (electrical characteristics) of the equipment 1, and environmental information around the equipment 1. Then, the equipment management device 2 is configured to calculate the estimated refrigerant amount 40 based on the acquired equipment acquisition data 10, the equipment information 20 and the equipment installation information 30 which are preset, and estimates an amount of the refrigerant in the equipment 1. Note that, for example, the estimation of the amount of the refrigerant may be performed by the external terminal 3 or the cloud 4, or by the cloud 4 via the external terminal 3.

As a result, the equipment management system SYS can estimate an amount of the refrigerant in the equipment 1 during normal operation, unlike the conventional estimation of the amount of the refrigerant. That is, the equipment management system SYS can accurately estimate an amount of the refrigerant in the equipment in an actual usage environment without requiring any special operation.

For example, the equipment information 20 includes at least information on a volume of a space in which the refrigerant can flow in the equipment 1 and a type of the refrigerant that the equipment 1 has. As a result, the equipment management system SYS can estimate, according to the type of the refrigerant, an amount of the refrigerant in the space in which the refrigerant can flow in the equipment 1.

Further, the equipment management device 2 is configured to calculate the amount of the refrigerant in the equipment 1 based on the volume of the space in which the refrigerant can flow in the equipment 1, and a refrigerant density determined based on the temperature of the refrigerant in the equipment 1 and the type of the refrigerant. As a result, the equipment management system SYS can accurately estimate the amount of the refrigerant in the equipment 1.

Further, the equipment management device 2 is further configured to calculate the amount of the refrigerant in the equipment 1 by adding an amount of the refrigerant dissolved in a refrigerating machine oil used in the equipment 1 (dissolved refrigerant amount 42) and an amount of the refrigerant in a liquid retention portion (retained refrigerant amount 43) to the amount of the refrigerant calculated based on the refrigerant density and the volume of the space through which the refrigerant can flow (converted refrigerant amount 41). That is, the equipment management device 2 calculates the estimated refrigerant amount 40 based on a sum of the converted refrigerant amount 41, the dissolved refrigerant amount 42, and the retained refrigerant amount 43. As a result, the equipment management system SYS can accurately estimate the amount of the refrigerant in the equipment 1 even in a transient phenomenon.

Further, in the equipment 1, the outdoor unit 100 including the compressor 102, the outdoor heat exchanger 104, and the expansion valve 103, and the indoor unit 200 including the indoor heat exchanger 201 are connected using internal-external connection pipes 301 and 302 through which the refrigerant flows. Further, the equipment installation information 30 includes at least information on the volumes of the internal-external connection pipes 301 and 302 (for example, diameters and lengths of the internal-external connection pipes 301 and 302). As a result, the equipment management system SYS can accurately estimate the amount of the refrigerant in the equipment 1, including the connection portion between the outdoor unit 100 and the indoor unit 200.

Further, the environmental information around the equipment 1 includes at least information on an ambient temperature of the equipment 1. For example, the ambient temperature includes a temperature of the environment (indoor) where the indoor unit 200 is installed (indoor temperature) or a temperature of the environment (outdoor) where the outdoor unit 100 is installed (outdoor temperature). As a result, the equipment management system SYS can accurately estimate the amount of the refrigerant in the equipment 1 in consideration of the ambient temperature of the equipment 1.

Further, in the equipment management system SYS, the equipment management device 2 includes the external terminal 3 or the cloud 4 that can communicate with the equipment 1. As a result, the equipment management system SYS can be easily applied to various equipments 1 since it is not necessary to provide the equipments 1 with a function necessary to estimate the amount of the refrigerant.

Further, in the equipment management system SYS according to the present embodiment, the refrigerant amount estimation method of estimating an amount of a refrigerant in the equipment 1 having the refrigerant includes: a step of the equipment management device 2 acquiring the equipment acquisition data 10 (measurement information) indicating a result of measuring a temperature of the refrigerant in the equipment 1, an electrical input (electrical characteristics) of the equipment 1, and environmental information around the equipment 1; and a step of the equipment management device 2 estimating an amount of the refrigerant in the equipment 1 based on the acquired equipment acquisition data 10, the equipment information 20 and the equipment installation information 30 which are preset.

As a result, the equipment management system SYS can estimate an amount of the refrigerant in the equipment 1 during normal operation, unlike the conventional estimation of the amount of the refrigerant. That is, the equipment management system SYS can accurately estimate an amount of the refrigerant in the equipment in an actual usage environment without requiring any special operation.

Second Embodiment

Next, a second embodiment will be described.

A basic configuration of the present embodiment is the same as that of the first embodiment, except for a difference that a plurality of equipments 1 are connected to the equipment management device 2.

Figure 15:
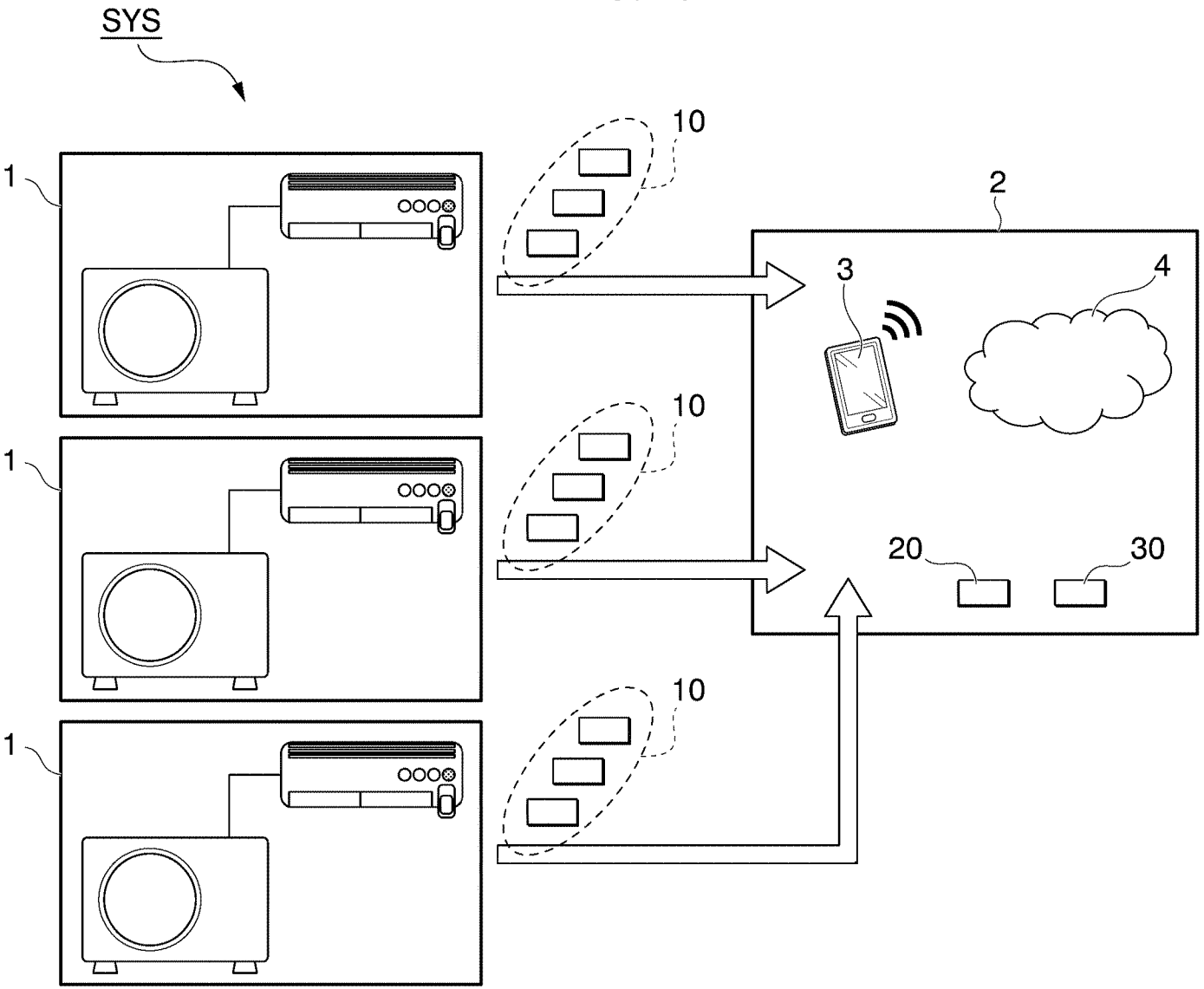
FIG. 15 is a schematic configuration diagram showing an example of an equipment management system according to a second embodiment.

FIG. 15 is a schematic configuration diagram showing an example of an equipment management system according to the present embodiment. The equipment management system SYS shown in this figure includes a plurality of equipments 1 having a refrigerant, and an equipment management device 2 that can communicate with each equipment 1. Note that although this figure shows an example in which there are three equipments 1, there may be two or four or more equipments 1.

A configuration and operation of the refrigerant amount estimation processing in the equipment management system SYS are the same as those of the first embodiment. For example, in the equipment management device 2, the acquisition unit 404 is configured to acquire the equipment acquisition data 10 from each of the plurality of equipments 1. The estimation unit 405 is configured to calculate an amount of the refrigerant in the plurality of equipments 1 (total refrigerant amount) based on the equipment acquisition data 10 acquired by the acquisition unit 404, the equipment information 20 and the equipment installation information 30 which are preset.

Thus, the equipment management system SYS can estimate the total amount of the refrigerant in the plurality of equipments 1 (total refrigerant amount) by collectively managing the equipment acquisition data 10, the equipment information 20, and the equipment installation information of each equipment 1. Further, the equipment management system SYS can also estimate the amount of the refrigerant for each of the plurality of equipments 1 individually.

Third Embodiment

Next, a third embodiment will be described.

A basic configuration of an equipment management system SYS according to present embodiment is the same as those of the first and second embodiments. Further, a basic operation of the equipment management system SYS according to present embodiment is the same as those of the first and second embodiments, except for a difference that a refrigerant management value is used.

The impact on the global environment differs depending on the type of refrigerant used in the equipment 1, and in general, there is a tendency for those with a high global warming potential (GWP) to be phased out of use in the market. For example, there are R410a and R32 as the refrigerant types used in the market, and the GWP of R410a is 2090, and the GWP of R32 is 675. In other words, R410a is the refrigerant type that has three times as much impact on global warming as R32. Therefore, the impact on the global environment (global warming) when using R410a is made equal by limiting the amount of refrigerant to one third of the amount when using R32.

An amount of refrigerant for each refrigerant type whose use is restricted in the equipment 1 (refrigerant amount serving as a reference for each refrigerant type) is defined as the above-described refrigerant management value. For example, the refrigerant management value is calculated by a sum of an amount of refrigerant charged at the time of shipment of the equipment 1 and an additional amount of refrigerant necessary to be charged for the equipment 1.

Figure 16:
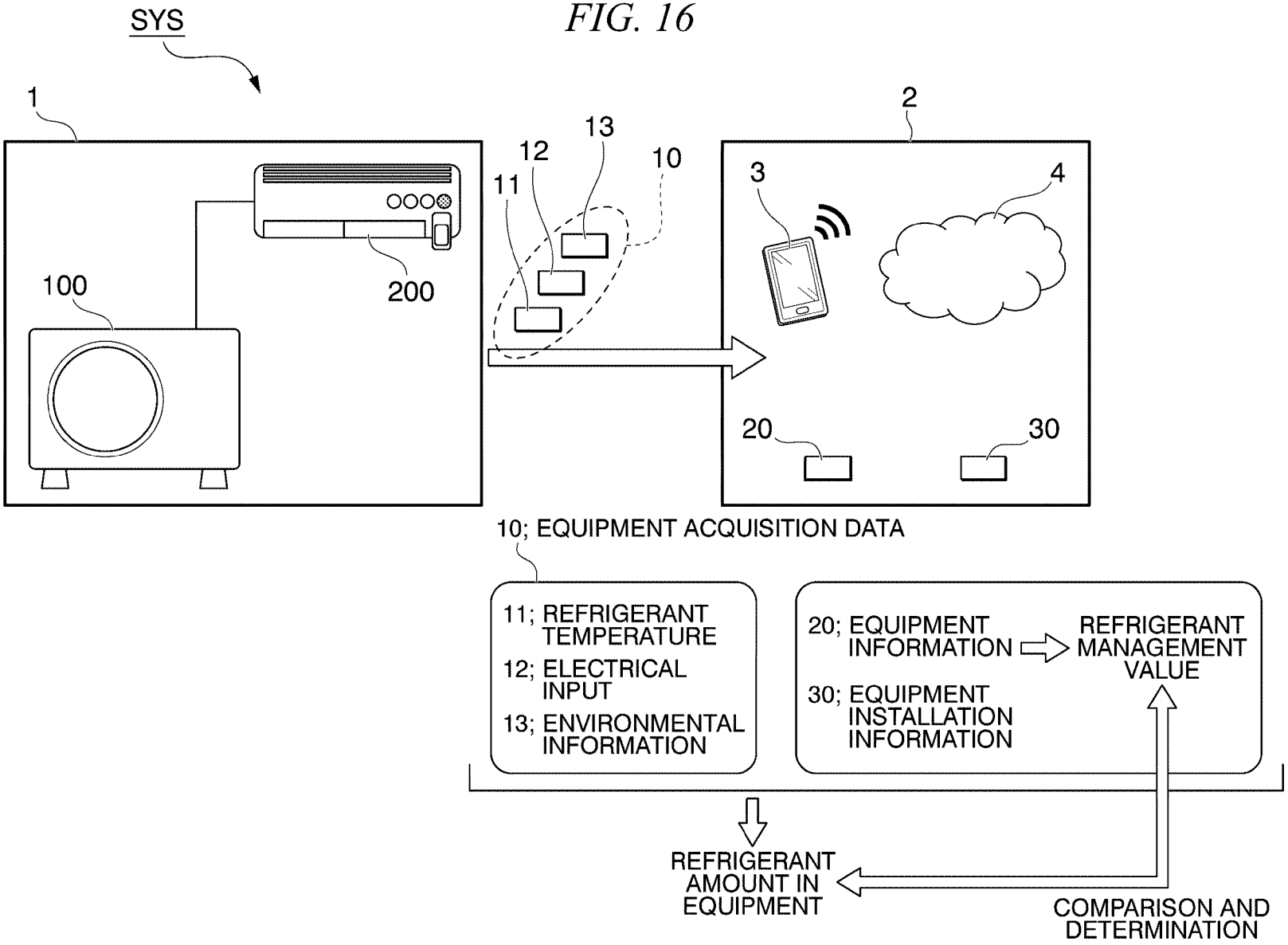
FIG. 16 is a schematic configuration diagram showing an example of an equipment management system according to a third embodiment.

FIG. 16 is a schematic configuration diagram showing an example of the equipment management system according to the present embodiment.

The equipment management device 2 estimates an amount of refrigerant in the equipment 1 based on the equipment acquisition data 10, the equipment information 20, and the equipment installation information 30, and also compare the estimated refrigerant amount (estimated refrigerant amount 40) and the refrigerant management value to determine whether the amount of refrigerant in the equipment 1 is excessive or insufficient.

Figure 17:
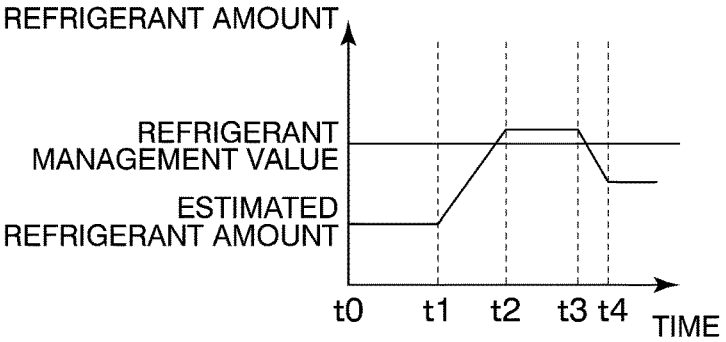
FIG. 17 is a diagram showing an example of time-series data stored by the equipment management device according to the third embodiment.

For example, since the equipment management device 2 is configured to estimate the amount of refrigerant in the equipment 1 at an arbitrary timing in addition to internal regular processing, time-series data as shown in FIG. 17 can be stored. For example, the estimation unit 405 calculates a refrigerant management value of the equipment 1 based on a sum of an amount of refrigerant charged at the time of shipment of the equipment 1 and an additional amount of refrigerant necessary to be charged for the equipment 1. Then, the estimation unit 405 compares the estimated value of the refrigerant amount in the equipment 1 with the refrigerant management value of the equipment 1, and determines whether the amount of refrigerant in the equipment is excessive or insufficient.

FIG. 17 is a diagram showing an example of time-series data stored by the equipment management device. This figure shows time-series data of a refrigerant management value and an estimated refrigerant amount value at each time. The estimated refrigerant amount value from time t0 to t1 is an estimated value of the amount of refrigerant charged in the equipment 1 at the time of installation, and corresponds to the amount of refrigerant charged at the time of shipment of the equipment 1. Next, if the equipment 1 is charged with an additional amount of refrigerant necessary for the equipment from time t1 to t2, the estimated refrigerant amount value becomes close to the refrigerant management value at time t2. Thereafter, if the amount of refrigerant in the equipment 1 decreases after time t3 due to external factors or the like, the estimated refrigerant amount value decreases after time t3, and then the estimated refrigerant amount value reaches a certain value and becomes stable after time t4.

The equipment management device 2 can determine whether the amount of refrigerant in the equipment 1 is excessive or insufficient by comparing a difference between the refrigerant management value and the estimated refrigerant amount value based on the time series data as shown in FIG. 17.

Note that if it is determined that the amount of refrigerant in the equipment 1 is insufficient, it is assumed that the refrigerant gas has leaked and decreased. On the other hand, if the amount of refrigerant in the equipment 1 is excessive, it is assumed that the refrigerant gas is overcharged. For example, if the estimated refrigerant amount value is continuously decreasing, the equipment management device 2 can recognize that refrigerant gas is leaking.

Further, the equipment management device 2 determines whether the amount of refrigerant in the equipment 1 is excessive or insufficient by sampling at any timing with high determination accuracy (for example, 30 minutes after startup of the equipment 1, etc.) or periodically (for example, every minute), and outputs a result as instantaneous values or time series data.

For example, when determining whether the amount of refrigerant in one equipment 1 is excessive or insufficient, the equipment management device 2 simply determines whether the amount of refrigerant in the equipment 1 is excessive or insufficient. On the other hand, when determining whether the amount of refrigerant in a plurality of equipments 1 is excessive or insufficient, the equipment management device 2 can also manage the amount of refrigerant used in the market.

Figure 18:
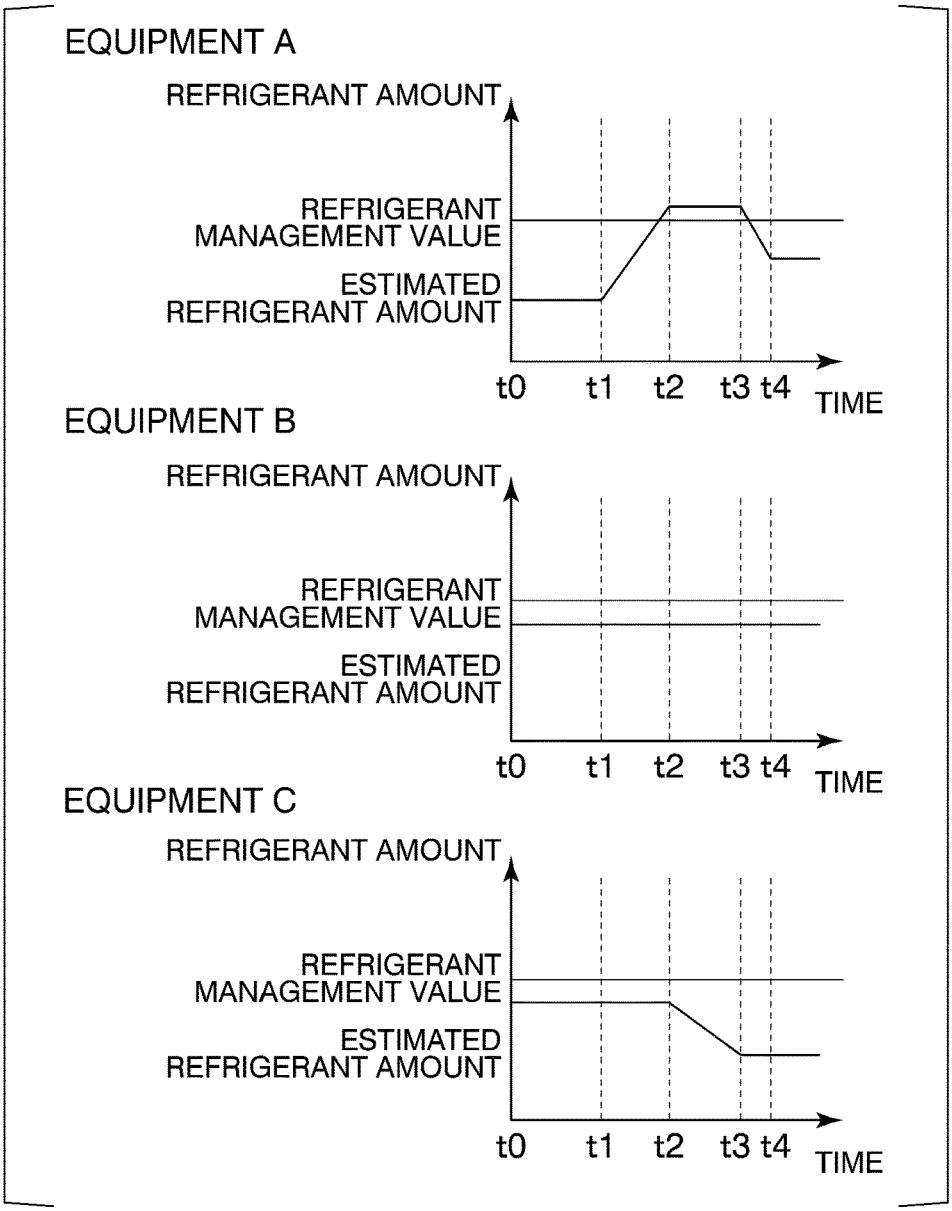
FIG. 18 is a diagram showing an example of time-series data of each of a plurality of equipments stored by the equipment management device according to the third embodiment.

For example, when the equipment management system SYS includes a plurality of equipments 1, the equipment management device 2 can acquire time series data of a refrigerant management value and an estimated refrigerant amount value at each time for each of the plurality of equipments 1 as shown in FIG. 18. FIG. 18 is a diagram showing an example of time-series data of each of the plurality of equipments 1 (here, equipment A, equipment B, and equipment C) stored by the equipment management device 2.

The equipment management device 2 can grasp the total amount of refrigerant in the plurality of equipments 1 at the time of installation by calculating a sum of the estimated refrigerant amount values at time to which is the time when each of the plurality of equipments 1 is installed. Further, in the example shown in FIG. 18, it can be understood that only the equipment A is additionally charged with refrigerant between time t1 and t2, and refrigerant leakage occurs in the equipment A because the refrigerant gas decreases between time t3 and time t4. Similarly, it can be understood that refrigerant leakage occurs in the equipment C between time t2 and time t3. Further, if the equipments A to C were removed at time t4, it can be understood that the remaining refrigerant except for the refrigerant leaked from the equipments A and C could be recovered.

Therefore, it can be understood that although the leaked refrigerant affects the environment, the recovered refrigerant does not affect the environment even if replacement is made with a new equipment 1 having the same amount of refrigerant. This provides the effect that the equipment 1 having the refrigerant can be used continuously. Note that even if the new equipment 1 uses a different type of refrigerant, the replacement can be made without affecting the environment by applying a refrigerant management value according to the type of refrigerant.

Fourth Embodiment

Next, a fourth embodiment will be described.

A basic configuration of an equipment management system SYS according to present embodiment is the same as those of the first and second embodiments. Further, a basic operation of the equipment management system SYS according to the present embodiment is the same as those of the first and second embodiments, except for differences that the performance of the equipment 1 is estimated based on the estimated refrigerant amount 40, and the estimated operational performance is compared with the equipment information 20 of the equipment 1, published inspection data, catalog information, or the like. The catalog information is information described in a catalog of a manufacturer of the equipment 1, and includes, for example, numerical values related to the specifications of the equipment 1.

Figure 19:
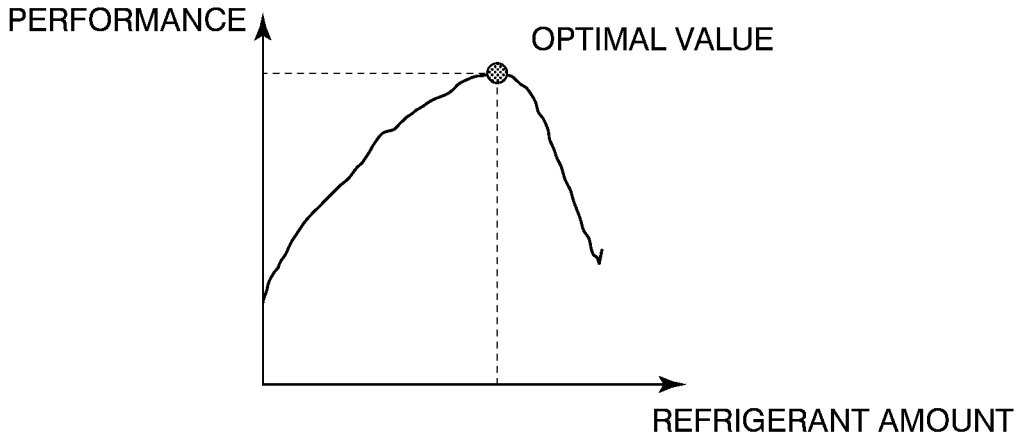
FIG. 19 is a diagram showing an example of a relationship between an amount of refrigerant and performance of an equipment according to a fourth embodiment.
Figure 20:
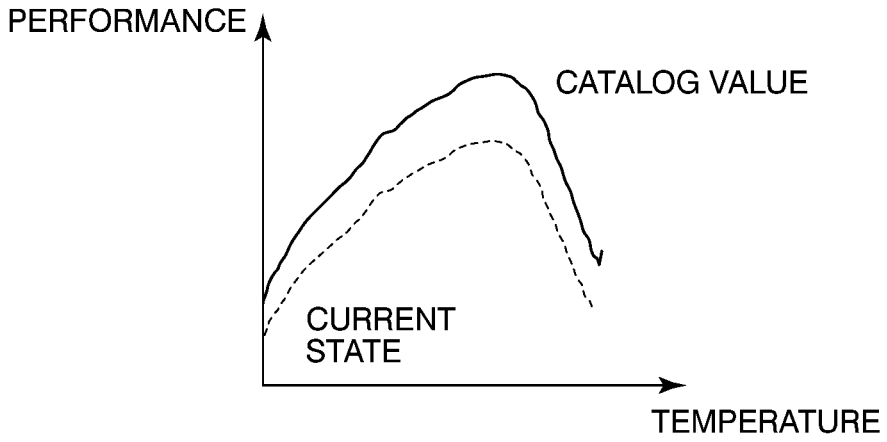
FIG. 20 is a diagram showing an example of comparison with catalog values regarding a relationship between the performance of the equipment and a temperature according to the fourth embodiment.

FIG. 19 is a diagram showing an example of a relationship between the amount of refrigerant and the performance of the equipment according to the present embodiment. FIG. 20 is a diagram showing an example of comparison with catalog values regarding a relationship between the performance of the equipment and the temperature according to the present embodiment. Here, the performance of the equipment 1 refers to, for example, operational performance such as cooling, heating, dehumidification, and refrigeration. Note that the performance of the equipment 1 may be expressed as power consumption of the equipment 1.

The equipment management device 2 calculates the estimated refrigerant amount 40 of the equipment 1 having the characteristics as shown in FIG. 19, and determines the performance of the equipment 1 from the calculated estimated refrigerant amount 40. Then, the equipment management device 2 summarizes the calculated performance of the equipment 1 as the characteristics as shown in FIG. 20. Note that the relationship between the amount of refrigerant and the performance of the equipment 1 shown in FIG. 19 is determined by numerical calculation based on the equipment information 20 and the equipment installation information 30. Similarly, the example shown in FIG. 20 is determined by numerical calculation based on the equipment information 20, the published inspection data, or the catalog information. Note that the published inspection data or the catalog information is included in the equipment information 20.

Thus, the equipment management system SYS according to the present embodiment can grasp the performance of the equipment 1 by estimating the performance of the equipment 1 based on the equipment information 20, the equipment installation information 30, and the estimated amount of refrigerant. Further, when the equipment management system SYS has a plurality of equipments 1, it is possible to grasp the performance of the plurality of equipments 1 as a whole as well as the performance of each equipment 1. Further, the equipment management system SYS compares the estimated performance of each equipment 1 or the overall performance of the plurality of equipments 1 with the equipment information 20, the published inspection data, or the catalog information, thereby making it possible to evaluate the performance of the equipment 1 and grasp the validity of the performance of the equipment 1, for example.

Fifth Embodiment

Next, a fifth embodiment will be described.

A basic configuration of an equipment management system SYS according to present embodiment is the same as those of the first and second embodiments, except for a difference that it further includes a general-purpose device.

Figure 21:
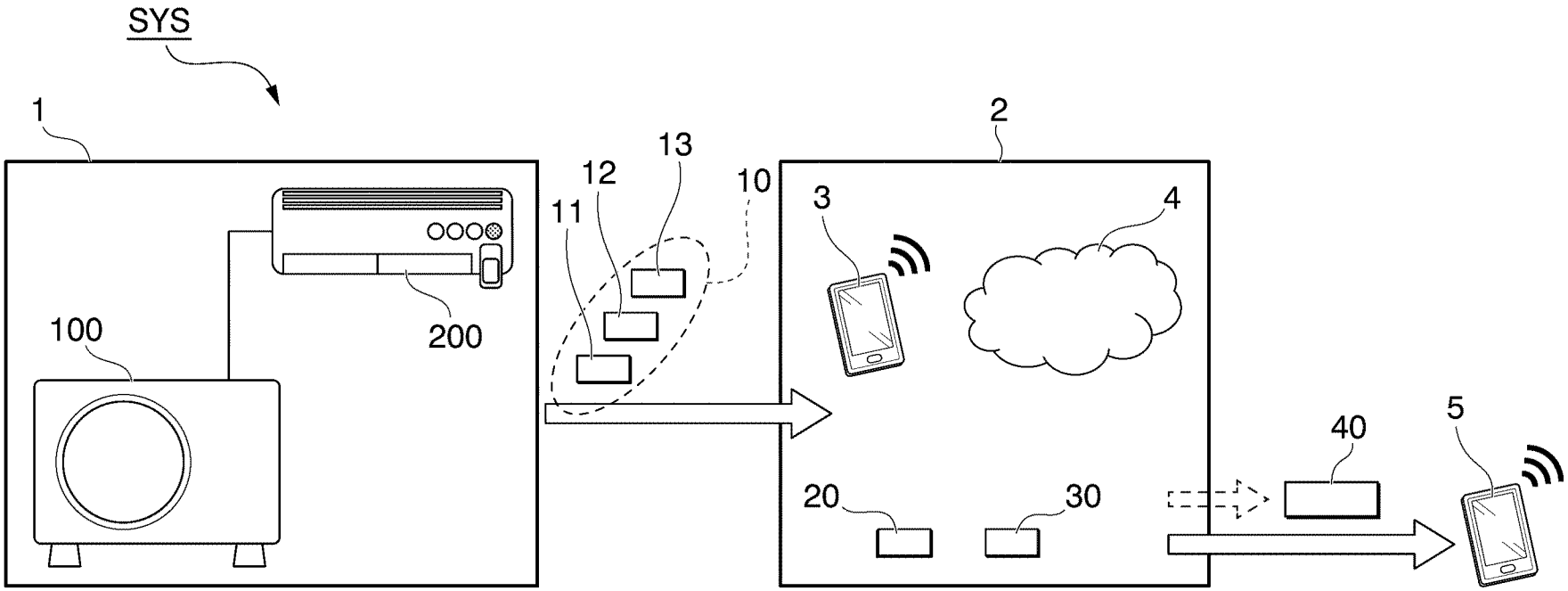
FIG. 21 is a schematic configuration diagram showing an example of an equipment management system according to a fifth embodiment.

FIG. 21 is a schematic configuration diagram showing an example of the equipment management system according to the present embodiment. In this figure, the equipment management device 2 is configured to be able to communicate with a general-purpose device 5. Here, the general-purpose device 5 is an example of an external device, and is a device having a display screen (for example, a smartphone, a PC), a device that emits sound (for example, a wireless earphone), or the like.

A basic operation of the equipment management system SYS according to present embodiment is the same as those of the first to fourth embodiments, except for a difference that information on the estimated refrigerant amount 40 or the performance of the equipment 1 calculated by the equipment management device 2 is output from the general-purpose device 5 to provide visual or auditory guidance or warning to a user.

For example, the equipment management device 2 transmits to the general-purpose device 5, the information on the estimated refrigerant amount 40 or the performance of the equipment 1, thereby causing the general-purpose device 5 to display the information. Further, the equipment management device 2 may transmit to the general-purpose device 5, information on the excess or deficiency of the amount of refrigerant in the equipment 1 determined based on a result of the comparison between the estimated refrigerant amount 40 of the equipment 1 and the refrigerant management value, thereby causing the general-purpose device 5 to display the information. Further, the equipment management device 2 may transmit to the general-purpose device 5, information on a result of the determination based on a comparison between the performance of the equipment 1 and the equipment information 20, the published inspection data, or the catalog information, thereby causing the general-purpose device 5 to display the information.

Specifically, the output unit 406 of the equipment management device 2 outputs the information on the estimated refrigerant amount 40 or the performance of the equipment 1 to the communication unit 402, thereby transmitting the information to the general-purpose device 5. The general-purpose device 5 acquires the information on the estimated refrigerant amount 40 or the performance of the equipment 1 transmitted from the equipment management device 2, and causes the information to be displayed on the display screen of the general-purpose device 5. Further, the output unit 406 outputs the information on the excess or deficiency of the amount of refrigerant in the equipment 1 to the communication unit 402, thereby transmitting the information to the general-purpose device 5. The general-purpose device 5 acquires the information on the excess or deficiency of the amount of refrigerant in the equipment 1 transmitted from the equipment management device 2, and causes the information to be displayed on the display screen of the general-purpose device 5. Note that the general-purpose device 5 may output these information items transmitted from the equipment management devices 2 in the form of audio.

Figure 22:
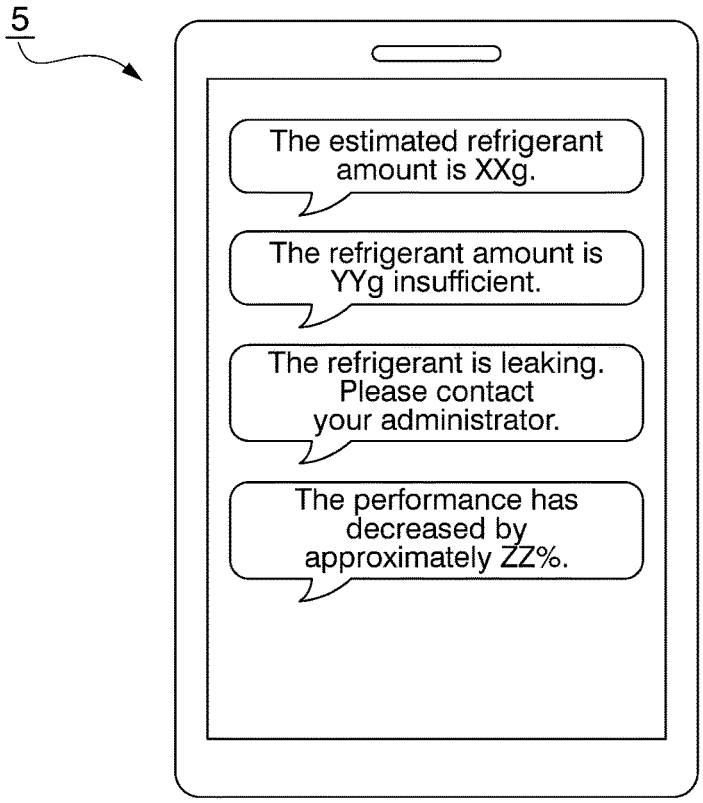
FIG. 22 is a diagram showing an example of a display displayed on a general-purpose device according to the fifth embodiment.

FIG. 22 is a diagram showing an example of a display displayed on the general-purpose device 5 according to the present embodiment. This figure shows an example of display of information that provides guidance or warning about a value of the estimated refrigerant amount 40, the shortage of refrigerant in the equipment 1, the leakage of refrigerant, a result of the performance determination, and the like. Note that the display example shown in this figure is an example, and is not limited to this.

Note that the visual or auditory guidance or warning is provided, for example, when it is determined that the amount of refrigerant in the equipment 1 is continuously insufficient. This is for the purpose that in this case, the refrigerant gas is considered to have leaked, so that a user is urged to contact an administrator of the equipment 1 or a repair company, or if the equipment 1 is in operation, the user is urged to stop the operation of equipment 1 or switch to a mode that shuts off the refrigerant leakage, so as to minimize the effects of the refrigerant gas leak.

Here, when it is assumed that the conditions other than the amount of refrigerant are equal under certain environmental conditions or operating conditions of the equipment 1, the performance of the equipment 1 can be expressed by a function using the amount of refrigerant as a parameter. When power consumption is taken as an example of the performance of the equipment 1, if the amount of refrigerant is insufficient, the amount of heat exchanged in the heat exchanger will decrease according to the decreased amount of refrigerant, so that the power consumption will decrease. A similar trend can be seen in the operating performance of cooling, heating, dehumidification, or refrigeration.

Therefore, the equipment management device 2 can determine the performance of the equipment 1 based on the estimated amount of refrigerant, and provides visual or auditory guidance or warning about the result thereof to the user or administrator of the equipment 1 via the general-purpose device 5. Further, even when a plurality of equipments 1 are connected, the equipment management device 2 can determine the performance of each equipment 1 based on the amount of refrigerant estimated for each equipment 1. Note that the equipment management device 2 compares the performance of each equipment 1 obtained at this time with the equipment information 20, the published inspection data, or the catalog information so as to be able to objectively judge the performance of each equipment 1.

Further, when the amount of refrigerant in the equipment 1 is insufficient relative to the refrigerant management value of the equipment 1 and the performance of the equipment 1 is decreased, the equipment management device 2 provides visual or auditory guidance or warning that the performance is decreased due to the insufficient amount of refrigerant gas.

Thus, the equipment management system SYS according to the present embodiment outputs information providing visual or auditory guidance or warning via the general-purpose device 5, based on a result of the estimation of the refrigerant amount or the performance of the equipment 1. As a result, the equipment management system SYS allows various people (e.g., an unspecified number of people), such as users of the equipment 1, workers or repairers who maintain the equipment 1, and administrators, to easily grasp the status of the equipment 1.

Sixth Embodiment

Next, a sixth embodiment will be described.

A basic configuration and operation of an equipment management system SYS according to the present embodiment are the same as those of the fifth embodiment, and information is transmitted from the equipment management device 2 to the general-purpose device 5, thereby causing the general-purpose device 5 to display the information. The present embodiment differs from the fifth embodiment in the content displayed by the general-purpose device 5.

The equipment management device 2 transmits to the general-purpose device 5, information on a fault or maintenance of the equipment 1 based on the calculated refrigerant amount or performance of the equipment 1, the equipment acquisition data 10, the equipment information 20, the equipment installation information 30, and the like, thereby causing the general-purpose device 5 to display the information. The information on the fault or maintenance is, for example, information that assists in fault or maintenance work and is information that is useful to workers.

Specifically, the output unit 406 of the equipment management device 2 outputs information on a fault or maintenance of the equipment 1 to the communication unit 402, thereby transmitting the information to the general-purpose device 5. The general-purpose device 5 acquires the information on the fault or maintenance transmitted from the equipment management device 2 and causes the information to be displayed on the display screen of the general-purpose device 5. Note that the general-purpose device 5 may output these information items transmitted from equipment management devices 2 in the form of audio.

Figure 23:
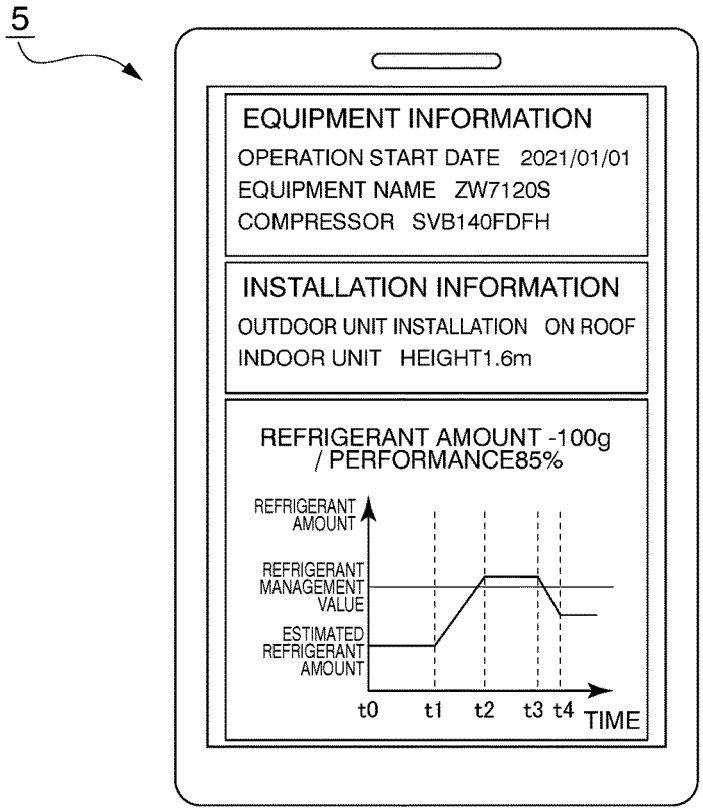
FIG. 23 is a diagram showing an example of a display displayed on a general-purpose device according to a sixth embodiment.

FIG. 23 is a diagram showing an example of a display displayed on the general-purpose device 5 according to the present embodiment. In the display example shown in this figure, as information on the equipment 1, an operation start date, an equipment name, and a compressor model are displayed. Further, as the installation information of the equipment 1, information on an installation location of the outdoor unit and a height at which the indoor unit is installed is displayed. Further, an estimated refrigerant amount value and performance of the equipment 1, and a graph of time-series data of the estimated refrigerant amount value and the refrigerant management value are displayed. These display information is information that assists in fault or maintenance work. Note that the display example shown in this figure is an example, and is not limited to this. For example, according to the display example shown in FIG. 23, it is possible to grasp the amount of refrigerant in the equipment 1 as an instantaneous value or in a time series, and also to confirm the information that will assist in fault or maintenance work of the equipment 1.

Thus, the equipment management system SYS according to the present embodiment outputs information on a fault or maintenance of the equipment 1 via the general-purpose device 5, based on a result of the estimation of the refrigerant amount or the performance of the equipment 1. As a result, the equipment management system SYS can confirm the information that will assist in fault or maintenance work of the equipment 1. Therefore, according to the present embodiment, it is possible to reduce the burden on workers of the fault or maintenance work of the equipment 1, and to improve the efficiency of the work.

Seventh Embodiment

Next, a seventh embodiment will be described.

A basic configuration and operation of an equipment management system SYS according to present embodiment are the same as those of the fourth embodiment.

As described in the fourth embodiment, the equipment management device 2 estimates the performance of the equipment 1 based on the amount of refrigerant in the equipment 1. In the present embodiment, the equipment management device 2 causes the equipment 1 to perform pre-cooling or pre-warming in advance when there is a possibility that the environment in which the equipment 1 is used exceeds the capacity of the equipment 1, based on the estimated performance of the equipment 1.

For example, compared to the equipment 1 with a regular charged amount (refrigerant amount that satisfies the refrigerant management value), an equipment 1 with a lower refrigerant amount has the lower performance, so that a control such as increasing the frequency of the compressor 102 is performed. However, due to an increase in pressure caused by the increase in frequency, the equipment 1 may stop intermittently due to a protective operation.

In this case, for example, if the time required for the equipment 1 to reach the set temperature during cooling operation increases and the indoor air conditioning load increases beyond the capacity of the equipment 1, the room temperature may not decrease, but may rise. Therefore, the equipment management device 2 reduces the indoor air conditioning load by causing the equipment 1 to perform pre-cooling to prevent the equipment 1 from entering the protective operation even if its performance has deteriorated.

For example, when a reservation for cooling or heating operation is made in the equipment 1, the equipment management device 2 (processor 403) acquires the reserved time from the equipment 1 via the communication unit 402, and also determines whether or not there is a possibility that the current environment (e.g., temperature) exceeds the cooling or heating capacity based on the performance of the equipment 1 determined based on the estimated refrigerant amount value. If the processor 403 determines that there is a possibility that the current environment exceeds the cooling or heating capacity based on the performance of the equipment 1, the processor 403 transmits to the equipment 1 via the communication unit 402, an instruction that causes the equipment 1 to perform cooling or heating operation in advance of the reservation time. In response to receiving this instruction, the equipment 1 performs pre-cooling or pre-warming operation.

Thus, the equipment management system SYS according to the present embodiment causes the equipment 1 to perform the pre-cooling or pre-warming operation, based on the performance of the equipment 1. As a result, the equipment management system SYS can operate the equipment 1 more stably than when pre-cooling or pre-warming is not performed when the environment in which equipment 1 is used exceeds the capacity of the equipment 1.

For example, when the environment exceeds the capacity of the equipment 1, the equipment 1 may not be able to withstand the load, and therefore may perform a protective operation such as stopping or suppressing the operation to protect the equipment 1 itself. When the equipment 1 performs the protective operation, the equipment 1 becomes unusable, which may make the user using the equipment 1 uncomfortable. According to the present embodiment, since the equipment 1 is controlled to perform the pre-cooling or pre-warming operation based on the performance of the equipment 1, it is possible to prevent such a protective operation of the equipment 1 from occurring. For example, even if the performance of the equipment 1 is degraded due to factors such as a decrease in the heat exchange performance of the heat exchanger due to defacement or blockage of the air passage, or a lack of refrigerant gas, the impact on use can be minimized.

Further, not only in the case of cooling or heating, but also in the case of dehumidifying or refrigerating, the equipment management system SYS may similarly perform dehumidifying or refrigerating operation in advance of the reservation time when the environment in which the equipment 1 is used exceeds the capacity of the equipment 1.

Although each embodiment has been described above in detail with reference to the drawings, the specific configuration is not limited to these embodiments, and each embodiment may be combined, modified, or omitted as appropriate.

Note that in the above embodiments, the air conditioner capable of switching between cooling operation and heating operation has been described as an example of the equipment 1, but the equipment 1 may also be a cooling-only machine or a heating-only machine. In the case of a cooling-only machine, the refrigerant circuit shown in FIG. 2 excluding the four-way valve 101 is used only for cooling. Further, in the case of a heating-only machine, the refrigerant circuit shown in FIG. 2 excluding the four-way valve 101 is used only for heating.

Further, the equipment 1 is not limited to an air conditioner as long as it has a refrigerant. For example, the equipment 1 may be a refrigerator, a freezer, or the like, which includes a set of a condenser and an evaporator. In the case of a refrigerator or a freezer, the refrigerant circuit is used only for cooling.

Figure 24:
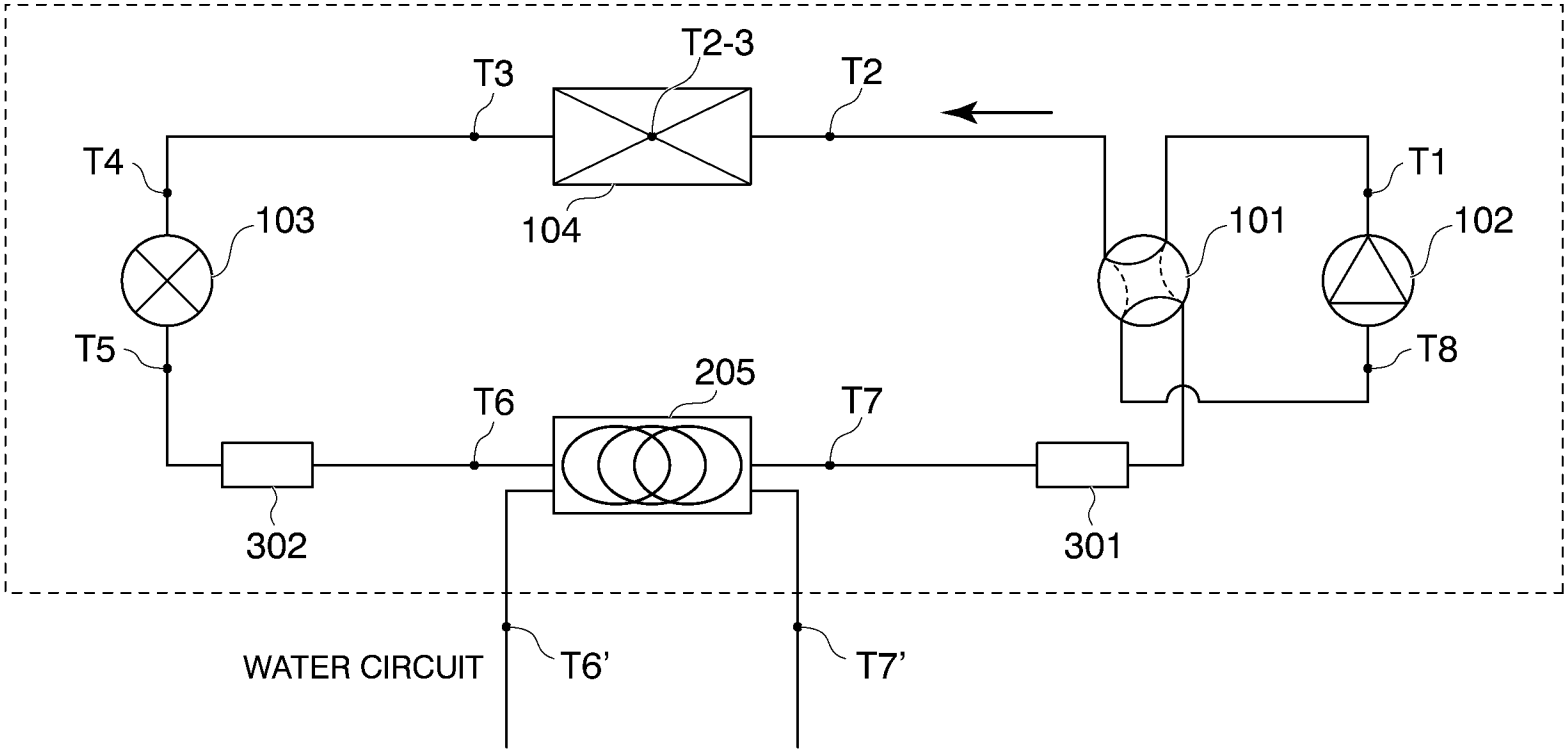
FIG. 24 is a diagram showing an example of a refrigerant circuit of a water heater as a modified example.

Further, for example, the equipment 1 may be a water heater (ATW: Air-To-Water). FIG. 24 is a diagram showing an example of a refrigerant circuit when the equipment 1 is a water heater. In FIG. 24, the same reference numerals are given to configurations corresponding to the respective components in FIG. 2. When calculating a heat exchange amount of a gas cooler 205, the equipment 1 (water heater) may use inlet and outlet temperatures T6' and T7' of a water circuit, instead of inlet and outlet refrigerant temperatures T6 and T7 of the gas cooler 205.

Further, the examples of the Mollier diagrams shown in FIGS. 5 and 6 differ depending on the type of refrigerant. For example, a CO2 refrigerant used in water heaters becomes supercritical during operation, so that there is no distinction between a liquid phase and a gas phase, but a relationship between pressure and enthalpy change is similar to the example shown in FIG. 6. Further, in a water heater, if a refrigerant temperature in the gas cooler 205 cannot be measured, it can be converted from a refrigerant circulation amount, a water amount in the water circuit, the inlet and outlet temperatures T6' and T7' of the water circuit, and a heat exchange efficiency.

Further, in the above embodiment, the example in which the equipment management device 2 is the external terminal 3 or the cloud 4 has been described, but the equipment management device 2 is not limited to this. For example, the equipment management device 2 may be included in the equipment 1.

Note that a program for realizing the functions of the equipment management device 2 may be recorded on a computer-readable recording medium, so that a computer system reads and executes the program recorded on the recording medium to perform the processing of the equipment management device 2. Note that the "computer system" herein includes an OS and hardware such as peripheral devices.

Further, the "computer-readable recording medium" refers to portable media such as flexible disks, magneto-optical disks, ROMs and CD-ROMs, and storage devices such as hard disks built into computer systems. Further, the "computer-readable recording medium" includes: a medium that dynamically stores a program for a short period of time, such as a communication line in a case where a program is transmitted via a network such as the Internet or a communication line such as a telephone line; and a medium that stores a program for a certain period of time, such as a volatile memory inside a computer system that serves as a server or a client in the above case. Further, the above-described program may be one for realizing part of the functions described above, or may be one capable of realizing the functions described above in combination with a program already recorded in the computer system. Further, the above-described program may be stored in a predetermined server, so that it will be distributed (downloaded, or the like) via a communication line in response to a request from another device.

Further, part or all of the functions of the equipment management device 2 may be implemented as an integrated circuit such as an LSI (Large Scale Integration). Each function may be individually processorized, and part or all of the functions may be integrated and processorized. Further, the integrated circuit is not limited to an LSI, and may be implemented as a dedicated circuit or a general-purpose processor. Further, when an integrated circuit technology that replaces the LSI appears due to advances in semiconductor technology, an integrated circuit based on that technology may be used.

The invention claimed is:

1. An equipment management system comprising:

an equipment having a refrigerant;

a processor configured to acquire measurement information indicating a result of measuring a temperature of the refrigerant in the equipment, electrical characteristics of the equipment, and environmental information around the equipment, and estimate an amount of the refrigerant in the equipment based on the measurement information, equipment information on the equipment and equipment installation information on an installation environment of the equipment, the equipment information and the equipment installation information being preset, wherein the equipment installation information includes at least one of a position of an installation location of the equipment, a building specification, and an installation direction, the processor is configured to estimate performance of the equipment based on the equipment information, the equipment installation information, and the estimated amount of the refrigerant in the equipment, and the processor is configured to cause the equipment to perform pre-cooling or pre-warming operation, based on the estimated performance of the equipment.

2. The equipment management system according to claim 1, wherein the equipment information includes at least information on a volume of a space in which the refrigerant can flow in the equipment and a type of the refrigerant that the equipment has.

3. The equipment management system according to claim 2, wherein the processor is further configured to calculate the amount of the refrigerant in the equipment based on the volume of the space in which the refrigerant can flow in the equipment, and a refrigerant density determined based on the temperature of the refrigerant in the equipment and the type of the refrigerant.

4. The equipment management system according to claim 3, wherein the processor is further configured to calculate the amount of the refrigerant in the equipment by adding an amount of the refrigerant dissolved in a refrigerating machine oil used in the equipment and an amount of the refrigerant in a liquid retention portion to the calculated amount of the refrigerant.

5. The equipment management system according to claim 1, wherein in the equipment, an outdoor unit including a compressor, an outdoor heat exchanger, and an expansion valve, and an indoor unit including an indoor heat exchanger are connected by a connection pipe through which the refrigerant flows, and the equipment installation information includes at least information on a volume of the connection pipe.

6. The equipment management system according to claim 1, wherein the environmental information around the equipment includes at least information on an ambient temperature of the equipment.

7. The equipment management system according to claim 1, wherein the processor is configured to acquire the measurement information from each of a plurality of equipments including the equipment, and calculate a total amount of the refrigerant in the plurality of equipments based on the measurement information from each of the plurality of equipments, the equipment information, and the equipment installation information.

8. The equipment management system according to claim 1, wherein the processor is configured to, based on the equipment information, calculate a refrigerant management value indicating a reference amount of the refrigerant for each refrigerant type.

9. The equipment management system according to claim 8, wherein the processor is configured to determine whether the amount of the refrigerant in the equipment is excessive or insufficient by comparing the estimated amount of the refrigerant in the equipment with the refrigerant management value.

10. The equipment management system according to claim 1, wherein the equipment information includes inspection data or catalog information of the equipment under a specific inspection condition before shipping of the equipment, and the processor is configured to compare the estimated performance of the equipment with the equipment information, the inspection data, or the catalog information.

11. The equipment management system according to claim 1, comprising:

an external terminal or a group of arithmetic processing devices that can communicate with the equipment, wherein the processor is provided in the external terminal or the group of arithmetic processing devices.

12. The equipment management system according to claim 1, wherein the processor is further configured to output information providing visual or auditory guidance or warning via an external device, based on a result of the estimation.

13. The equipment management system according to claim 1, wherein the processor is further configured to output information on a fault or maintenance of the equipment via an external device, based on a result of the estimation.

14. The equipment management system according to claim 1, wherein the processor is configured to determine whether a current environment exceeds a cooling capacity or a heating capacity of the equipment based on the estimated performance of the equipment, and when the current environment exceeds the cooling capacity or the heating capacity of the equipment, cause the equipment to perform the pre-cooling or pre-warming operation.

15. The equipment management system according to claim 14, wherein the processor is configured to acquire information regarding a reservation for a cooling operation or a heating operation from the equipment, and when the current environment exceeds the cooling capacity or the heating capacity of the equipment, cause the equipment to perform the pre-cooling or pre-warming operation in advance of a reservation time.

16. A refrigerant amount estimation method of estimating an amount of a refrigerant in an equipment having the refrigerant, comprising:

acquiring measurement information indicating a result of measuring a temperature of the refrigerant in the equipment, electrical characteristics of the equipment, and environmental information around the equipment;

estimating an amount of the refrigerant in the equipment based on the measurement information acquired, equipment information on the equipment and equipment installation information on an installation environment of the equipment, the equipment information and the equipment installation information being preset;

estimating performance of the equipment based on the equipment information, the equipment installation information, and the estimated amount of the refrigerant in the equipment; and causing the equipment to perform pre-cooling or pre-warming operation, based on the estimated performance of the equipment, wherein the equipment installation information includes at least one of a position of an installation location of the equipment, a building specification, and an installation direction.

17. The refrigerant amount estimation method according to claim 16, comprising:

based on the equipment information, calculating a refrigerant management value indicating a reference amount of the refrigerant for each refrigerant type.

18. The refrigerant amount estimation method according to claim 17, comprising:

determining whether the amount of the refrigerant in the equipment is excessive or insufficient by comparing the estimated amount of the refrigerant in the equipment with the refrigerant management value.

19. The refrigerant amount estimation method according to claim 16, further comprising:

determining whether a current environment exceeds a cooling capacity or a heating capacity of the equipment based on the estimated performance of the equipment, and when the current environment exceeds the cooling capacity or the heating capacity of the equipment, causing the equipment to perform the pre-cooling or pre-warming operation.

20. The refrigerant amount estimation method according to claim 19, further comprising:

acquiring information regarding a reservation for a cooling operation or a heating operation, and when the current environment exceeds the cooling capacity or the heating capacity of the equipment, causing the equipment to perform the pre-cooling or pre-warming operation in advance of a reservation time.

* * * * *